US011488543B2

(12) United States Patent
Kim

(10) Patent No.: US 11,488,543 B2
(45) Date of Patent: Nov. 1, 2022

(54) GATE DRIVING CIRCUIT AND DISPLAY DEVICE

(71) Applicant: LG Display Co., Ltd., Seoul (KR)

(72) Inventor: KwangSoo Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/560,127

(22) Filed: Dec. 22, 2021

(65) Prior Publication Data

US 2022/0208127 A1 Jun. 30, 2022

(30) Foreign Application Priority Data

Dec. 24, 2020 (KR) ..... 10-2020-0183696

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/0291* (2013.01); *G09G 2310/08* (2013.01)

(58) Field of Classification Search
CPC ..... G09G 2310/0286; G09G 2310/08; G09G 2310/0267; G09G 2310/0289; G09G 3/3677; G09G 3/3266; G09G 3/3648; G09G 3/3688; G09G 3/3674; G09G 2300/0426; G09G 2300/0408; G09G 2230/00
See application file for complete search history.

(56) References Cited

U.S. PATENT DOCUMENTS

2007/0001991 A1* 1/2007 Jang ..... G09G 3/3677 345/100
2012/0212275 A1* 8/2012 Jang ..... G11C 19/28 327/295
2013/0010916 A1* 1/2013 Jang ..... G09G 3/3677 377/64
2016/0055814 A1 2/2016 Yang et al.
2016/0182042 A1 6/2016 Kim et al.

* cited by examiner

*Primary Examiner* — Dong Hui Liang
(74) *Attorney, Agent, or Firm* — Seed IP Law Group LLP

(57) ABSTRACT

A gate driving circuit includes a first gate driving circuit and a second gate driving circuit, wherein the m number of first clock signals input to the first gate driving circuit includes an (n+1)-th clock signal and an (n+k)-th clock signal, and the m number of second clock signals input to the second gate driving circuit includes an (n+2)-th clock signal and an (n+k+1)-th clock signal, where the n is any integer, and the k is a natural number of 3 or more, a high level voltage duration of the (n+1)-th clock signal and a high level voltage duration of the (n+k)-th clock signal do not overlap, and a high level voltage duration of the (n+2)-th clock signal and a high level voltage duration of the (n+k+1)-th clock signal do not overlap.

18 Claims, 23 Drawing Sheets

GATE DRIVING CIRCUIT AND DISPLAY DEVICE

CROSS-REFERENCE TO RELATED APPLICATION

This application claims the priority benefit Republic of Korea Patent Application No. 10-2020-0183696, filed on Dec. 24, 2020 in the Korean Intellectual Property Office, the disclosure of which is incorporated herein by reference in its entirety.

BACKGROUND

Technical Field

The present disclosure relates to gate driving circuits and touch display devices including the gate driving circuit.

Description of the Related Art

As the advent of information society, there have been growing needs for display devices for displaying images. To meet such needs, recently, various types of display devices, such as a Liquid Crystal Display (LCD) device, an Electroluminescence Display (ELD) device including a Quantum-dot Light Emitting Display device, and an Organic Light Emitting Display (e.g., OLED) device, and the like, have been developed and widely used.

Generally, display devices charge a capacitor disposed in each of a plurality of sub-pixels arranged on a display panel and use the charged capacitance for display driving. However, in such typical display devices, such a capacitor in each sub-pixel may be insufficiently charged, and thereby, image quality may be deteriorated.

In typical display devices, if a size of the non-display area of a display panel can be reduced, design freedom of the display device can be increased and design quality can be improved. However, since various lines and circuit elements are arranged in the non-display area of the display panel, in actuality, it is not easy to reduce the size of the non-display area of the display panel.

In addition, in the case of such a typical display device, an insufficient charging time may cause image quality to become poor, and further, gate driving may malfunction due to differences in output characteristics between gate signals, this leading image quality to become poor.

BRIEF SUMMARY

Embodiments of the present disclosure provide a gate driving circuit having a clock input structure capable of reducing differences in output characteristics between gate signals, and thereby, improving image quality, and a display device including the gate driving circuit.

Embodiments of the present disclosure provide a gate driving circuit having a clock input structure in which overlap gate driving and a Q node sharing structure are enabled while reducing differences in output characteristics between gate signals, and a display device including the gate driving circuit.

According to embodiments of the present disclosure, a display device is provided that includes a display panel including a plurality of gate lines, a gate driving circuit including a first gate driving circuit capable of outputting m number of first gate signals using a first clock signal group, and a second gate driving circuit capable of outputting m number of second gate signals using a second clock signal group different from the first clock signal group, where m is a natural number of 2 or more.

Each of the first clock signal group and the second clock signal group may respectively include m number of first clock signals and m number of second clock signals, and 2 m number of clock signals including the m number of first clock signals included in the first clock signal group and the m number of second clock signals included in the second clock signal group may have respective high level voltage durations at different timings.

The first gate driving circuit may include m number of first output buffer circuits configured to receive the m number of first clock signals and output m number of first gate signals, and a first control circuit capable of controlling the m number of first output buffer circuits.

The second gate driving circuit may include m number of second output buffer circuits configured to receive the m number of second clock signals and output m number of second gate signals, and a second control circuit capable of controlling the m number of second output buffer circuits.

Each of the m number of first output buffer circuits may include a pull-up transistor and a pull-down transistor, and all of corresponding gate nodes of the respective pull-up transistor included in the m number of first output buffer circuits may be electrically connected to one first Q node.

Each of the m number of second output buffer circuits can include a pull-up transistor and a pull-down transistor, and all of corresponding gate nodes of the respective pull-up transistor included in the m number of second output buffer circuits may be electrically connected to one second Q node.

The m number of first clock signals input to the first gate driving circuit may include an (n+1)-th clock signal and an (n+k)-th clock signal, and the m number of second clock signals input to the second gate driving circuit may include an (n+2)-th clock signal and an (n+k+1)-th clock signal, where n is any integer and k is a natural number 3 or more.

A high level voltage duration of the (n+1)-th clock signal and a high level voltage duration of the (n+2)-th clock signal may partially overlap. A high level voltage duration of the (n+k)-th clock signal and a high level voltage duration of the (n+k+1)-th clock signal may partially overlap.

The high level voltage duration of the (n+1)-th clock signal and the high level voltage duration of the (n+k)-th clock signal may not overlap. The high level voltage duration of the (n+2)-th clock signal and the high level voltage duration of the (n+k+1)-th clock signal may not overlap.

In the case of k=3, the m number of first output buffer circuits included in the first gate driving circuit may include a first first output buffer circuit for receiving an (n+1)-th clock signal and outputting the (n+1)-th gate signal, and a second first output buffer circuit for receiving an (n+3)-th clock signal and outputting an (n+3)-th gate signal. The m number of second output buffer circuits included in the second gate driving circuit may include a first second output buffer circuit for receiving the (n+2)-th clock signal and outputting an (n+2)-th gate signal, and a second second output buffer circuit for receiving an (n+4)-th clock signal and outputting an (n+4)-th gate signal.

In the case of k=3, the (n+1)-th gate signal may be applied to an (n+1)-th gate line, the (n+3)-th gate signal may be applied to an (n+3)-th gate line, the (n+2)-th gate signal may be applied to an (n+2)-th gate line, and the (n+4)-th gate signal may be applied to an (n+4)-th gate line.

In this case, the display panel may include at least one of a connection line connecting between the first first output buffer circuit outputting the (n+1)-th gate signal and the (n+1)-th gate line disposed in the display panel, a connection line connecting between the second first output buffer circuit outputting the (n+3)-th gate signal and the (n+3)-th gate line disposed in the display panel, a connection line between connecting the first second output buffer circuit outputting the (n+2)-th gate signal and the (n+2)-th gate line disposed in the display panel, and a connection line connecting between the second second output buffer circuit outputting the (n+4)-th gate signal and the (n+4)-th gate line disposed in the display panel.

In the case of k=3, the (n+1)-th gate signal may be applied to the (n+1)-th gate line, the (n+3)-th gate signal may be applied to the (n+2)-th gate line, the (n+2)-th gate signal may be applied to an (n+1+m)-th gate line, and the (n+4)-th gate signal may be applied to an (n+2+m)-th gate line.

In the case of k=3 and m=4, the m number of first output buffer circuits included in the first gate driving circuit may further include a third first output buffer circuit for receiving an (n+5)-th clock signal and outputting an (n+5)-th gate signal, and a fourth first output buffer circuit for receiving an (n+7)-th clock signal and outputting an (n+7)-th gate signal. The m number of second output buffer circuits included in the second gate driving circuit may further include a third second output buffer circuit for receiving an (n+6)-th clock signal and outputting an (n+6)-th gate signal, and a fourth second output buffer circuit for receiving an (n+8)-th clock signal and outputting an (n+8)-th gate signal.

In the case of k=3 and m=4, the (n+1)-th gate signal may be applied to the (n+1)-th gate line, the (n+3)-th gate signal may be applied to the (n+3)-th gate line, the (n+5)-th gate signal may be applied to an (n+5)-th gate line, the (n+7)-th gate signal may be applied to an (n+7)-th gate line, the (n+2)-th gate signal may be applied to the (n+2)-th gate line, the (n+4)-th gate signal may be applied to the (n+4)-th gate line, and the (n+6)-th gate signal may be an (n+6)-th gate line, and the (n+8)-th gate signal may be applied to an (n+8)-th gate line.

In this case, the display panel may include at least one of the connection line connecting between the first first output buffer circuit outputting the (n+1)-th gate signal and the (n+1)-th gate line disposed in the display panel, the connection line connecting between the second first output buffer circuit outputting the (n+3)-th gate signal and the (n+3)-th gate line disposed in the display panel, a connection line connecting between the third first output buffer circuit outputting the (n+5)-th gate signal and the (n+5)-th gate line disposed in the display panel, a connection line connecting between the fourth first output buffer circuit outputting the (n+7)-th gate signal and the (n+7)-th gate line disposed in the display panel, the connection line connecting between the first second output buffer circuit outputting the (n+2)-th gate signal and the (n+2)-th gate line disposed in the display panel, the connection line connecting between the second second output buffer circuit outputting the (n+4)-th gate signal and the (n+4)-th gate line disposed in the display panel, a connection line connecting between the third second output buffer circuit outputting the (n+6)-th gate signal and the (n+6)-th gate line disposed in the display panel, and a connection line connecting between the fourth second output buffer circuit outputting the (n+8)-th gate signal and the (n+8)-th gate line disposed in the display panel.

In the case of k=3 and m=4, the (n+1)-th gate signal may be applied to the (n+1)-th gate line, the (n+3)-th gate signal may be applied to the (n+2)-th gate line, the (n+5)-th gate signal may be applied to the (n+3)-th gate line, the (n+7)-th gate signal may be applied to the (n+4)-th gate line, the (n+2)-th gate signal may be applied to the (n+1+m)-th gate line, the (n+4)-th gate signal may be applied to the (n+2+m)-th gate line, the (n+6)-th gate signal may be an (n+3+m)-th gate line, and the (n+8)-th gate signal may be applied to an (n+4+m)-th gate line.

The first gate driving circuit can output the (n+1)-th gate signal based on the (n+1)-th clock signal and an (n+k)-th gate signal based on an (n+k)-th clock signal. The second gate driving circuit can output the (n+2)-th gate signal based on the (n+2)-th clock signal and an (n+k+1)-th gate signal based on an (n+k+1)-th clock signal.

A turn-on level voltage duration of the (n+1)-th gate signal may partially overlap a turn-on level voltage duration of the (n+2)-th gate signal, and the turn-on level voltage duration of the (n+1)-th gate signal may not overlap a turn-on level voltage duration of the (n+k)-th gate signal G(n+k).

According to embodiments of the present disclosure, a gate driving circuit capable of driving a plurality of gate lines disposed in a display panel is provided. The gate driving circuit has the same structure as that included in the above display device.

According to embodiments of the present disclosure, it is possible to provide the gate driving circuit having a clock input structure capable of reducing differences in output characteristics between gate signals, and thereby, improving image quality, and the display device including the gate driving circuit.

According to embodiments of the present disclosure, it is possible to provide the gate driving circuit having a clock input structure in which overlap gate driving and a Q node sharing structure are enabled while reducing differences in output characteristics between gate signals, and the display device including the gate driving circuit.

BRIEF DESCRIPTION OF THE SEVERAL VIEWS OF THE DRAWINGS

The accompanying drawings, which are included to provide a further understanding of the disclosure and are incorporated in and constitute a part of the disclosure, illustrate embodiments of the disclosure and together with the description serve to explain the principle of the disclosure. In the drawings.

DETAILED DESCRIPTION

Figure 1:
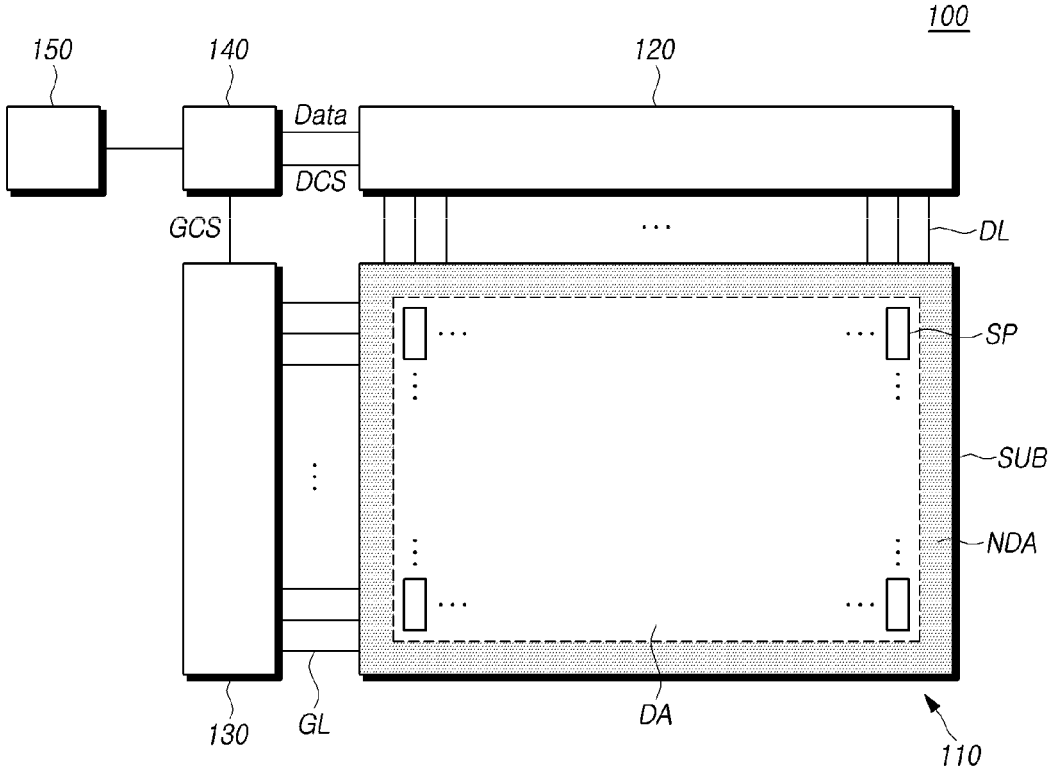
FIG. 1 illustrates a system configuration of a display device according to an embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including," "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present disclosure. Each of these terms is not used to define essence, order, sequence, or number of elements, etc., but is used merely to distinguish the corresponding element from other elements.

When it is mentioned that a first element "is connected or coupled to," "contacts or overlaps," etc., a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc., each other via a fourth element. Here, the second element may be included in at least one of two or more elements that "are connected or coupled to," "contact or overlap," etc., each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes, etc., are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a system configuration of a display device 100 according to an embodiments of the present disclosure.

Referring to FIG. 1, the display device 100 according to an embodiments of the present disclosure includes a display panel 110 and a driving circuit for driving the display panel 110.

The driving circuits may include a data driving circuit 120, a gate driving circuit 130, and the like, and may further include a controller 140 that controls the data driving circuit 120 and the gate driving circuit 130.

The display panel 110 may include a substrate SUB, and signal lines such as a plurality of data lines DL, a plurality of gate lines GL, and the like disposed over the substrate SUB. The display panel 110 may include a plurality of sub-pixels SP connected to the plurality of gate lines GL and the plurality of data lines DL.

The display panel 110 may include a display area DA in which an image is displayed, and a non-display area NDA, in which an image is not displayed, different from the display area DA. In the display panel 110, the plurality of sub-pixels SP for displaying an image may be disposed in the display area DA, and the driving circuits 120, 130, and 140 may be electrically connected to, or mounted one in, the non-display area NDA. A pad portion in which an integrated circuit or a printed circuit is connected may be disposed in the non-display area NDA of the display panel 110.

The data driving circuit 120 is a circuit for driving the plurality of data lines DL, and can supply data signals to the plurality of data lines DL. The gate driving circuit 130 is a circuit for driving the plurality of gate lines GL, and can supply gate signals to the plurality of gate lines GL. The controller 140 can supply a data control signal DCS to the data driving circuit 120 in order to control an operation timing of the data driving circuit 120. The controller 140 can supply a gate control signal GCS to the gate driving circuit 130 in order to control an operation timing of the gate driving circuit 130.

The controller 140 starts a scanning operation according to timings scheduled in each frame, converts image data inputted from other devices or other image providing sources (e.g., host systems) to a data signal form used in the data driving circuit 120 and then supplies image data Data resulting from the converting to the data driving circuit 120, and controls the loading of the data to at least one pixel at a pre-configured time according to a scan timing.

The controller 140 can receive, in addition to input image data, several types of timing signals including a vertical synchronous signal VSYNC, a horizontal synchronous signal HSYNC, an input data enable signal DE, a clock signal CLK, and the like from other devices, networks, or systems (e.g., a host system 150).

To control the data driving circuit 120 and the gate driving circuit 130, the controller 140 can receive one or more of the timing signals such as the vertical synchronization signal VSYNC, the horizontal synchronization signal HSYNC, the input data enable signal DE, the clock signal, and the like, generate several types of control signals (DCS, GCS), and supply the generated signals to the data driving circuit 120 and the gate driving circuit 130.

The controller 140 may be implemented in a separate component from the data driving circuit 120, or integrated with the data driving circuit 120 and implemented into an integrated circuit.

The data driving circuit 120 can drive a plurality of data lines DL by receiving image data Data from the controller 140 and supplying data voltages to the plurality of data lines DL. Here, the data driving circuit 120 may also be referred to as a source driving circuit.

The data driving circuit 120 may include one or more source driver integrated circuits SDIC. Each source driver integrated circuit SDIC may include a shift register, a latch circuit, a digital-to-analog converter DAC, an output buffer, and the like. In some instances, each source driver integrated circuit SDIC may further include an analog to digital converter ADC.

In some embodiments, each source driver integrated circuit SDIC may be connected to the display panel 110 in a tape automated bonding (TAB) type, or connected to a conductive pad such as a bonding pad of the display panel 110 in a chip on glass (COG) type or a chip on panel (COP) type, or connected to the display panel 110 in a chip on film (COF) type.

The gate driving circuit 130 can output a gate signal of a turn-on level voltage or a gate signal of a turn-off level voltage according to the control of the controller 140. The gate driving circuit 130 can sequentially drive a plurality of gate lines GL by sequentially supplying the gate signal of the turn-on level voltage to the plurality of gate lines GL.

In some embodiments, the gate driving circuit 130 may be connected to the display panel 110 in the tape automated bonding (TAB) type, or connected to a conductive pad such as a bonding pad of the display panel 110 in the chip on glass (COG) type or the chip on panel (COP) type, or connected to the display panel 110 in the chip on film (COF) type. In another embodiment, the gate driving circuit 130 may be located in the non-display area NDA of the display panel 110 in a gate in panel (GIP) type. The gate driving circuit 130 may be disposed on or over a substrate SUB, or connected to the substrate SUB. That is, in the case of the GIP type, the gate driving circuit 130 may be disposed in the non-display area NDA of the substrate SUB. The gate driving circuit 130 may be connected to the substrate SUB in the case of the chip on glass (COG) type, the chip on film (COF) type, or the like.

At least one of the data driving circuit 120 and the gate driving circuit 130 may be disposed in the display area DA. For example, at least one of the data driving circuit 120 and the gate driving circuit 130 may be disposed not to overlap sub-pixels SP, or disposed to overlap one or more, or all, of the sub-pixels SP.

When a specific gate line is asserted by the gate driving circuit 130, the data driving circuit 120 can convert image data Data received from the controller 140 into data voltages in an analog form and supplies the data voltages resulting from the converting to a plurality of data lines DL.

The data driving circuit 120 may be located on, but not limited to, only one portion (e.g., an upper portion or a lower portion) of the display panel 110. In some embodiments, the data driving circuit 120 may be located on, but not limited to, two portions (e.g., an upper portion and a lower portion) of the display panel 110 or at least two of four portions (e.g., the upper portion, the lower portion, a left side, and a right side) of the display panel 110 according to driving schemes, panel design schemes, or the like.

The gate driving circuit 130 may be located on, but not limited to, only one portion (e.g., a left side or a right side) of the display panel 110. In some embodiments, the gate driving circuit 130 may be located on, but not limited to, two portions (e.g., a left side and a right side) of the display panel 110 or at least two of four portions (e.g., an upper portion, a lower portion, the left side, and the right side) of the display panel 110 according to driving schemes, panel design schemes, or the like.

The controller 140 may be a timing controller used in the typical display technology or a control apparatus/device capable of additionally performing other control functionalities in addition to the typical function of the timing controller. In some embodiments, the controller 140 may be one or more other control circuits different from the timing controller, or a circuit or component in the control apparatus/device The controller 140 may be implemented using various circuits or electronic components such as an integrated circuit (IC), a field programmable gate array (FPGA), an application specific integrated circuit (ASIC), a processor, and/or the like.

The controller 140 may be mounted on a printed circuit board, a flexible printed circuit, or the like, and may be electrically connected to the data driving circuit 120 and the gate driving circuit 130 through the printed circuit board, the flexible printed circuit, or the like.

The controller 140 may transmit signals to, and receive signals from, the data driving circuit 120 via one or more predetermined or selected interfaces. In some embodiments, such interfaces may include a low voltage differential signaling (LVDS) interface, an EPI interface, a serial peripheral interface (SPI), and the like. The controller 140 may include a storage medium such as one or more registers.

The display device 100 according to an embodiments of the present disclosure may be a display including a backlight unit such as a liquid crystal display device, or may be a self-emissive display such as an organic light emitting diode (OLED) display, a quantum dot (QD) display, a micro light emitting diode (M-LED) display, and the like. The backlight unit may be a backlight structure, and may be referred to as the backlight structure.

In case the display device 100 according to an embodiments of the present disclosure is the OLED display, each sub-pixel SP may include an OLED where the OLED itself emits light as a light emitting element. In case the display device 100 according to an embodiments of the present disclosure is the QD display, each sub-pixel SP may include a light emitting element including a quantum dot, which is a self-emissive semiconductor crystal. In case the display device 100 according to an embodiments of the present disclosure is the micro LED display, each sub-pixel SP may include a micro LED where the micro OLED itself emits light and which is based on an inorganic material as a light emitting element.

Figure 2A:
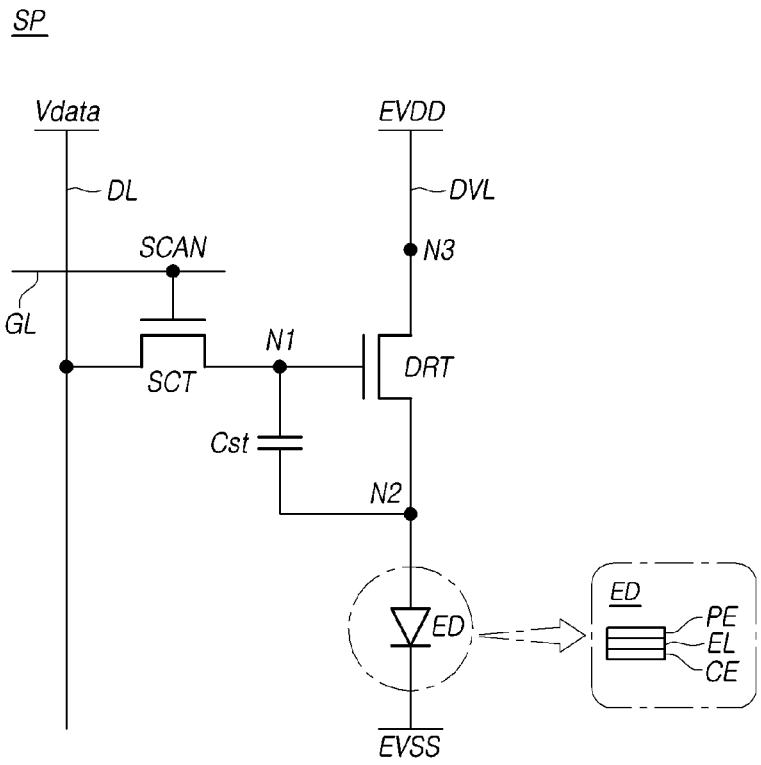
FIGS. 2A and 2B illustrate equivalent circuits for a sub-pixel of the display device according to an embodiments of the present disclosure.
Figure 2B:
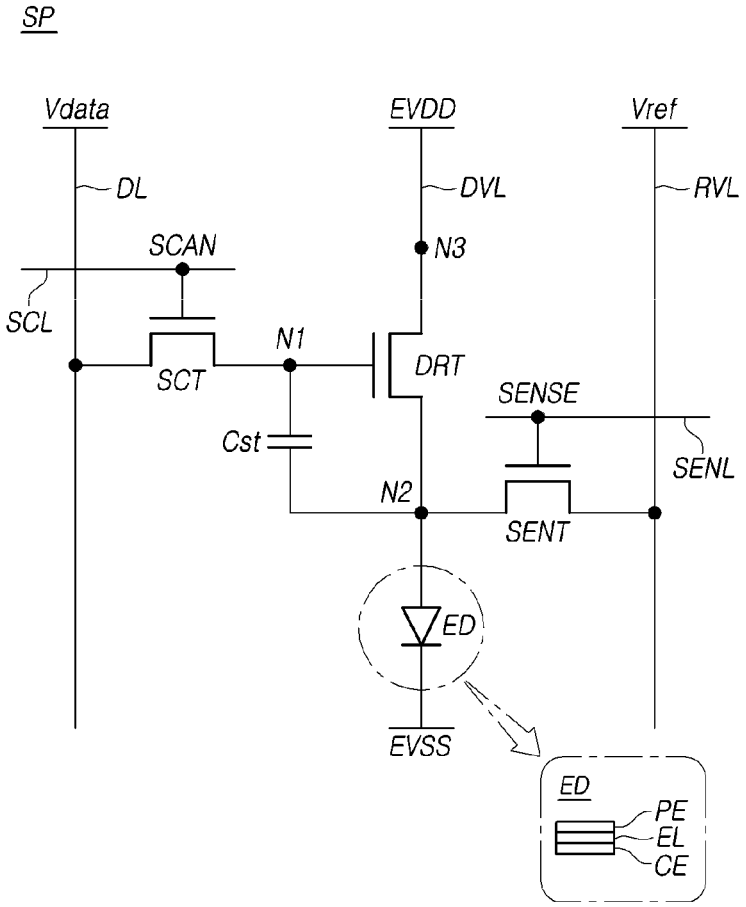

FIGS. 2A and 2B illustrate example equivalent circuits for a sub-pixel SP of the display device 100 according to an embodiments of the present disclosure.

Referring to FIG. 2A, each of a plurality of sub-pixels SP disposed in the display panel 110 of the display device 100 according to an embodiments of the present disclosure may include a light emitting element ED, a driving transistor DRT, and a scan transistor SCT and a storage capacitor Cst.

Referring to FIG. 2A, the light emitting element ED may include a pixel electrode PE and a common electrode CE, and include an emission layer EL located between the pixel electrode PE and the common electrode CE.

The pixel electrode PE of the light emitting element ED may be an electrode disposed in each sub-pixel SP, and the common electrode CE may be an electrode commonly disposed in all or some of the sub-pixels SP. Here, the pixel electrode PE may be an anode electrode and the common electrode CE may be a cathode electrode. In another embodiment, the pixel electrode PE may be the cathode electrode and the common electrode CE may be the anode electrode.

In one embodiment, the light emitting element ED may be an organic light emitting diode (OLED), a light emitting diode (LED), a quantum dot light emitting element or the like.

The driving transistor DRT may be a transistor for driving the light emitting element ED, and may include a first node N1, a second node N2, a third node N3, and the like.

The first node N1 of the driving transistor DRT may be a gate node of the driving transistor DRT, and may be electrically connected to a source node or a drain node of the scan transistor SCT. The second node N2 of the driving transistor DRT may be a source node or a drain node of the driving transistor DRT. The second node N2 may be also electrically connected to a source node or a drain node of a sensing transistor SENT, and connected to the pixel electrode PE of the light emitting element ED. A third node N3 of the driving transistor DRT may be electrically connected to a driving voltage line DVL for supplying a driving voltage EVDD.

The scan transistor SCT can be controlled by a scan signal SCAN, which is a type of gate signal, and may be connected between the first node N1 of the driving transistor DRT and a data line DL. In other words, the scan transistor SCT can be turned on or off according to the scan signal SCAN supplied through a scan signal line SCL, which is a type of the gate line GL, and control an electrical connection between the data line DL and the first node N1 of the driving transistor DRT.

The scan transistor SCT can be turned on by a scan signal SCAN having a turn-on level voltage, and passes a data voltage Vdata supplied through the data line DL to the first node of the driving transistor DRT.

In one embodiment, when the scan transistor SCT is an n-type transistor, the turn-on level voltage of the scan signal SCAN may be a high level voltage. In another embodiment, when the scan transistor SCT is a p-type transistor, the turn-on level voltage of the scan signal SCAN may be a low level voltage.

The storage capacitor Cst may be connected between the first node N1 and the second node N2 of the driving transistor DRT. The storage capacitor Cst can store the amount of electric charge corresponding to a voltage difference between both terminals and maintain the voltage difference between both terminals for a predetermined or selected frame time. Accordingly, a corresponding sub-pixel SP can emit light for the predetermined or selected frame time.

Referring to FIG. 2B, each of the plurality of sub-pixels SP disposed in the display panel 110 of the display device 100 according to an embodiments of the present disclosure may further include a sensing transistor SENT.

The sensing transistor SENT can be controlled by a sense signal SENSE, which is another type of gate signal, and may be connected between the second node N2 of the driving transistor DRT and a reference voltage line RVL. In other words, the sensing transistor SENT can be turned on or off according to the sense signal SENSE supplied through a sense signal line SENL, which is another type of the gate line GL, and control an electrical connection between the reference voltage line RVL and the second node N2 of the driving transistor DRT.

The sensing transistor SENT can be turned on by a sense signal SENSE having a turn-on level voltage, and pass a reference voltage Vref transmitted through the reference voltage line RVL to the second node of the driving transistor DRT.

Further, the sensing transistor SENT can be turned on by the sense signal SENSE having the turn-on level voltage, and transmit a voltage at the second node N2 of the driving transistor DRT to the reference voltage line RVL.

In one embodiment, when the sensing transistor SENT is an n-type transistor, the turn-on level voltage of the sense signal SENSE may be a high level voltage. In another embodiment, when the sensing transistor SENT is a p-type transistor, the turn-on level voltage of the sense signal SENSE may be a low level voltage.

The function of the sensing transistor SENT transmitting the voltage at the second node N2 of the driving transistor DRT to the reference voltage line RVL may be used when driven to sense at least one characteristic value of the sub-pixel SP. In this case, the voltage transmitted to the reference voltage line RVL may be a voltage for calculating at least one characteristic value of the sub-pixel SP or a voltage in which the at least one characteristic value of the sub-pixel SP is reflected.

Herein, the characteristic value of the sub-pixel SP may be a characteristic value of the driving transistor DRT or the light emitting element ED. The at least one characteristic value of the driving transistor DRT may include a threshold voltage and/or mobility of the driving transistor DRT. The characteristic value of the light emitting element ED may include a threshold voltage of the light emitting element ED.

The driving transistor DRT, the scan transistor SCT, and the sensing transistor SENT may be n-type transistors, p-type transistors, or combinations thereof. Herein, for convenience of description, it is assumed that the driving transistor DRT, the scan transistor SCT, and the sensing transistor SENT are n-type transistors.

The storage capacitor Cst may be an external capacitor intentionally designed to be located outside of the driving transistor DRT, other than an internal capacitor, such as a parasitic capacitor (e.g., a Cgs, a Cgd), that may be formed between the gate node and the source node (or drain node) of the driving transistor DRT.

The scan signal line SCL and the sense signal line SENL may be different gate lines GL. In some embodiments, the scan signal SCAN and the sense signal SENSE may be separate gate signals, and the on-off timing of the scan transistor SCT and the on-off timing of the sensing transistor SENT in one sub-pixel SP may be independent. That is, the on-off timing of the scan transistor SCT and the on-off timing of the sensing transistor SENT in one sub-pixel SP may be equal to, or different from, each other.

In another embodiment, the scan signal line SCL and the sense signal line SENL may be the same gate line GL. That is, a gate node of the scan transistor SCT and a gate node of the sensing transistor SENT in one sub-pixel SP may be connected to one gate line GL. In this embodiment, the scan signal SCAN and the sense signal SENSE may be the same gate signal, and the on-off timing of the scan transistor SCT and the on-off timing of the sensing transistor SENT in one sub-pixel SP may be the same.

It should be understood that the sub-pixel structures shown in FIGS. 2A and 2B are merely examples of possible sub-pixel structures for convenience of discussion, and embodiments of the present disclosure may be implemented in any of various structures, as desired. For example, the sub-pixel SP may further include at least one transistor and/or at least one capacitor.

Further, although discussions on the sub-pixel structures in FIGS. 2A and 2B have been conducted based on the assumption that the display device 100 is a self-emissive display device, when the display device 100 is a liquid crystal display, each sub-pixel SP may include a transistor, a pixel electrode, and the like.

Figure 3:
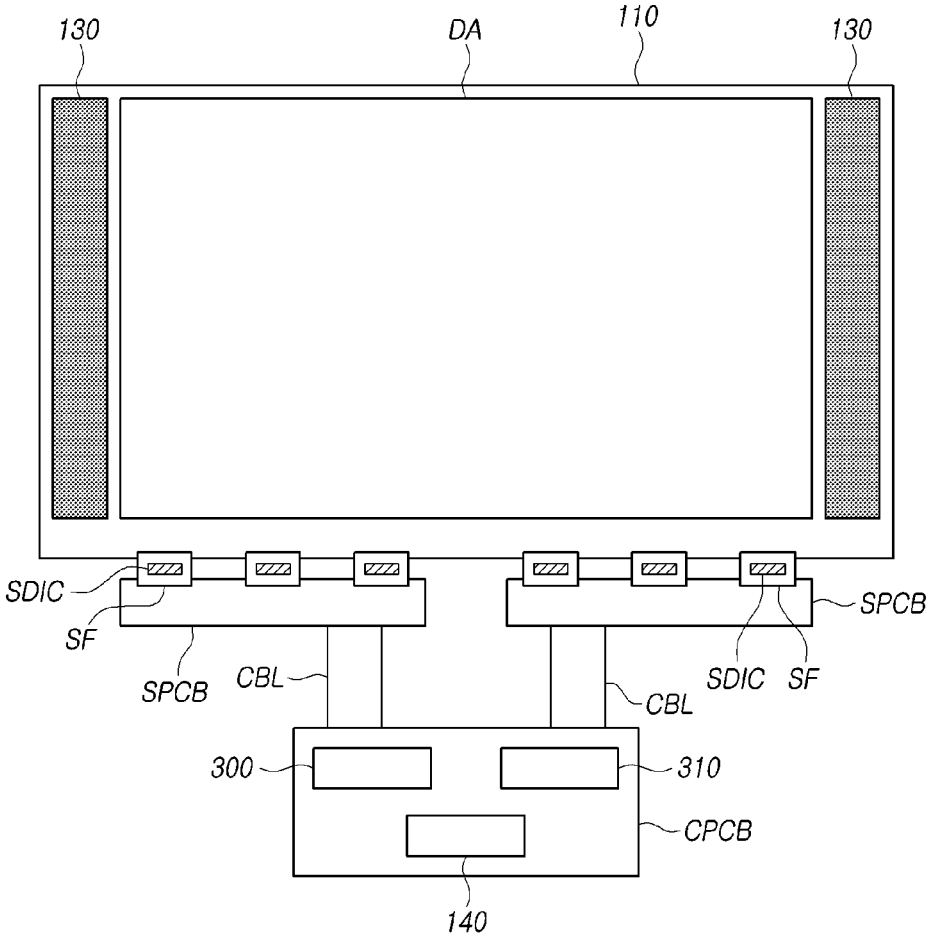
FIG. 3 illustrates an example system implementation of the display device according to an embodiments of the present disclosure.

FIG. 3 illustrates an example system implementation of the display device 100 according to an embodiments of the present disclosure.

Referring to FIG. 3, the display panel 110 may include a display area DA in which an image is displayed and a non-display area NDA in which an image is not displayed.

Referring to FIG. 3, when the data driving circuit 120 includes one or more source driver integrated circuits SDIC and is implemented in the chip on film (COF) type, each source driver integrated circuit SDIC may be mounted on a circuit film SF connected to the non-display area NDA of the display panel 110.

Referring to FIG. 3, the gate driving circuit 130 may be implemented in the gate in panel (GIP) type. In this embodiment, the gate driving circuit 130 may be located in the non-display area NDA of the display panel 110. In another embodiment, unlike the illustration in FIG. 3, the gate driving circuit 130 may be implemented in the chip on film (COF) type.

The display device 100 may include at least one source printed circuit board SPCB for a circuital connection between one or more source driver integrated circuits SDIC and other devices, components, and the like, and a control printed circuit board CPCB on which control components, and various types of electrical devices or components are mounted.

The circuit film SF on which the source driver integrated circuit SDIC is mounted may be connected to at least one source printed circuit board SPCB. That is, one side of the circuit film SF on which the source driver integrated circuit SDIC is mounted may be electrically connected to the display panel 110 and the other side thereof may be electrically connected to the source printed circuit board SPCB.

The controller 140 and the power management integrated circuit PMIC, 310 may be mounted on the control printed circuit board CPCB. The controller 140 can perform an overall control function related to the driving of the display panel 110 and control operations of the data driving circuit 120 and the gate driving circuit 130. The power management integrated circuit 310 can supply various types of voltages or currents to the data driving circuit 120 and the gate driving circuit 130 or control various types of voltages or currents to be supplied.

A circuital connection between at least one source printed circuit board SPCB and the control printed circuit board CPCB may be performed through at least one connection cable CBL. The connection cable CBL may be, for example, a flexible printed circuit FPC, a flexible flat cable FFC, or the like.

At least one source printed circuit board SPCB and the control printed circuit board CPCB may be integrated and implemented into one printed circuit board.

The display device 100 according to an embodiments of the present disclosure may further include a level shifter 300 for adjusting a voltage level. In one embodiment, the level shifter 300 may be disposed on the control printed circuit board CPCB or the source printed circuit board SPCB.

In the display device 100 according to an embodiments of the present disclosure, the level shifter 300 can supply signals beneficial for gate driving to the gate driving circuit 130. In one embodiment, the level shifter 300 can supply a plurality of clock signals to the gate driving circuit 130. Accordingly, the gate driving circuit 130 can supply a plurality of gate signals to a plurality of gate lines GL based on the plurality of clock signals input from the level shifter 300. The plurality of gate lines GL can carry the gate signals to the sub-pixels SP disposed in the display area DA of the substrate SUB.

Figure 4:
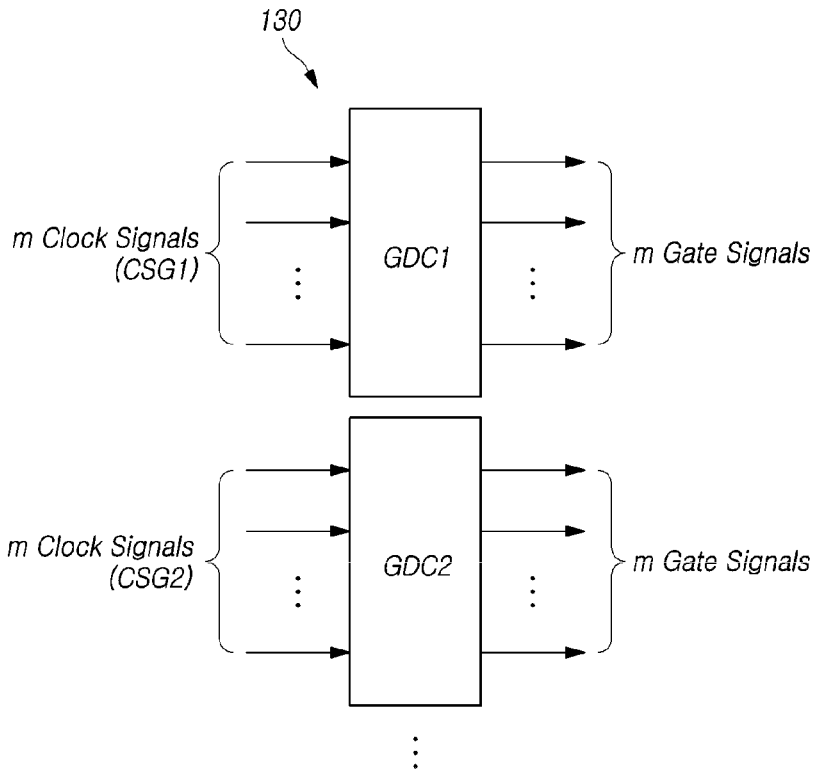
FIG. 4 is a block diagram of a gate driving circuit of the display device according to an embodiments of the present disclosure.

FIG. 4 is a block diagram of the gate driving circuit 130 of the display device 100 according to an embodiments of the present disclosure.

Referring to FIG. 4, the gate driving circuit 130 included in the display device 100 according to an embodiments of the present disclosure may be a circuit capable of driving a plurality of gate lines GL disposed on the display panel 110, generating a plurality of gate signals using a plurality of clock signals, and supplying the generated gate signals to the plurality of gate lines GL.

The gate driving circuit 130 may include a first gate driving circuit GDC1 outputting m number of gate signals using a first clock signal group CSG1, and a second gate driving circuit GDC2 outputting m number of gate signals using a second clock signal group CSG2 different form the first clock signal group CSG1, where m is a natural number of 2 or more.

Each of the first clock signal group CSG1 and the second clock signal group CSG2 may include m number of clock signals, where m is a natural number of 2 or more.

The first gate driving circuit GDC1 and the second gate driving circuit GDC2 may be circuits that generate and output the scan signals SCAN in the sub-pixel structures of FIGS. 2A and 2B. Accordingly, the m number of gate signals output from each of the first gate driving circuit GDC1 and the second gate driving circuit GDC2 may be scan signals SCAN.

In another embodiment, the first gate driving circuit GDC1 and the second gate driving circuit GDC2 may be circuits that generate and output the sense signal SENSE in the sub-pixel structure of FIG. 2B. Accordingly, the m number of gate signals output from each of the first gate driving circuit GDC1 and the second gate driving circuit GDC2 may be sense signals SENSE.

The first gate driving circuit GDC1 may include m number of first output buffer circuits. The m number of first output buffer circuits may be electrically connected to correspond to m number of gate lines GL. The m number of first output buffer circuits may output m number of gate signals to the m number of gate lines GL. Each of the m number of first output buffer circuits may include a pull-up transistor and a pull-down transistor.

The second gate driving circuit GDC2 may include m number of second output buffer circuits. The m number of second output buffer circuits may be electrically connected to correspond to m number of gate lines GL. The m number of second output buffer circuits may output m number of gate signals to the m number of gate lines GL. Each of the m number of second output buffer circuits may include a pull-up transistor and a pull-down transistor.

In some embodiments, the gate driving circuit 130 may have a Q node sharing structure in which one Q node is shared on m number of output buffer circuits basis, and a QB node sharing structure in which one QB node is shared on m number of output buffer circuits basis. A size of a bezel area (non-display area NDA) of the display panel 110 can be reduced through the Q node sharing structure and/or the QB node sharing structure. Here, m represents the number of output buffer circuits sharing one Q node, and may represent a basis on which one Q node is shared by output buffer circuits or a size in which one Q node is shared by output buffer circuits.

The first gate driving circuit GDC1 may have one first Q node and one first QB node. The gate nodes of the respective pull-up transistors included in the m number of first output buffer circuits included in the first gate driving circuit GDC1 can share one first Q node. The gate nodes of the respective pull-down transistors included in the m number of first output buffer circuits included in the first gate driving circuit GDC1 can share one first QB node.

The second gate driving circuit GDC2 may include m number of second output buffer circuits. The m number of second output buffer circuits may be electrically connected to correspond to m number of gate lines GL. The m number of second output buffer circuits may output m number of gate signals to the m number of gate lines GL. Each of the m number of second output buffer circuits may include a pull-up transistor and a pull-down transistor.

The second gate driving circuit GDC2 may have one second Q node and one second QB node. The gate nodes of the respective pull-up transistors included in the m number of second output buffer circuits included in the second gate driving circuit GDC2 can share one second Q node. The gate nodes of the respective pull-down transistors included in the m number of second output buffer circuits included in the second gate driving circuit GDC2 can share one second QB node.

Further, in some embodiments, the gate driving circuit 130 can perform overlap gate driving in order to improve image quality by increasing an insufficient charging time in each sub-pixel.

When the gate driving circuit 130 performs the overlap gate driving, the gate driving circuit 130 can output gate signals having a turn-on level voltage duration longer than a period of one horizontal (1H). In addition, a turn-on level voltage duration of one of the gate signals output from the gate driving circuit 130 may partially overlap a turn-on level voltage duration of another gate signal.

For example, in some embodiments, when the gate driving circuit 130 performs 2H overlap gate driving, a turn-on level voltage duration of each gate signal may have a time period of 2H. In addition, the period of 1H corresponding to the second half of the turn-on level voltage duration of one gate signal may overlap the period of 1H corresponding to the first half of the turn-on level voltage duration of another gate signal.

In some embodiments, when the gate driving circuit 130 performs 3H overlap gate driving, a turn-on level voltage duration of each gate signal may have a time period of 3H. In addition, the period of 2H corresponding to the second half of the turn-on level voltage duration of one gate signal may overlap the period of 2H corresponding to the first half of the turn-on level voltage duration of another gate signal. Hereinafter, the Q node sharing structure and overlap gate driving briefly described above will be described again with reference to FIGS. 5, 6A, and 6B.

Figure 5:
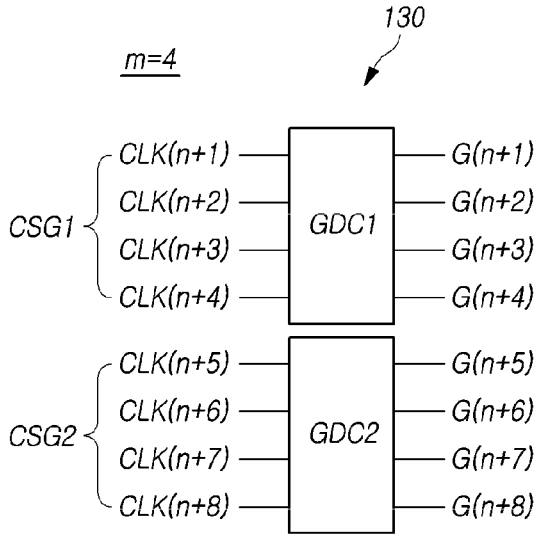
FIG. 5 illustrates a gate driving circuit having a first clock input structure included in the display device according to an embodiments of the present disclosure.
Figure 6A:
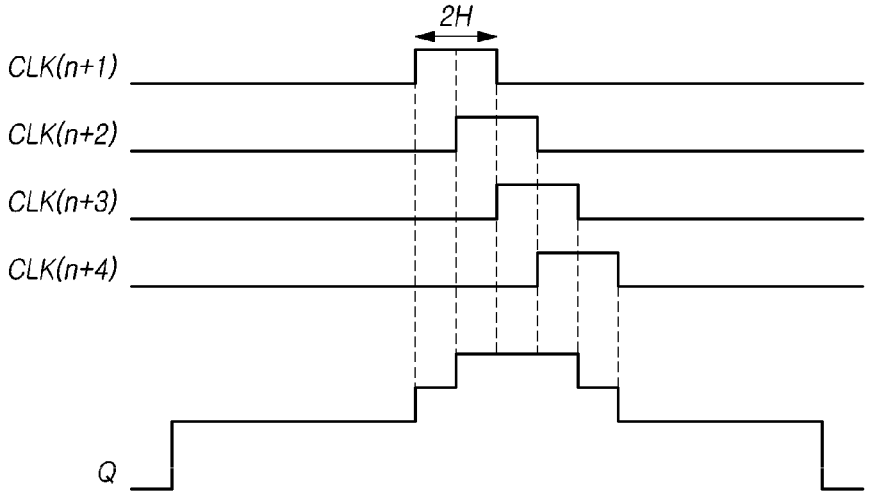
FIG. 6A illustrates 4 clock signals input to a first gate driving circuit when the gate driving circuit illustrated in FIG. 5 is used, and voltage fluctuations at a Q node of the first gate driving circuit.
Figure 6B:
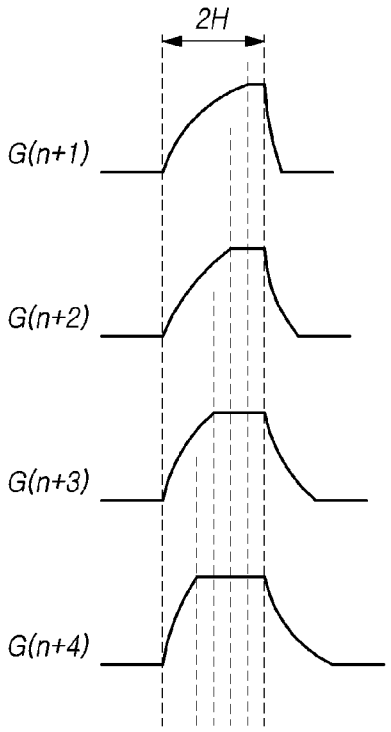
FIG. 6B illustrates 4 gate signals output from the first gate driving circuit when the gate driving circuit illustrated in FIG. 5 is used.

FIG. 5 illustrates a gate driving circuit 130 having a first clock input structure included in the display device 100 according to an embodiments of the present disclosure. FIG. 5 illustrates an example in the case of m=4. FIG. 6A illustrates four clock signals (CLK(n+1), CLK(n+2), CLK (n+3), and CLK(n+4)) input to the first gate driving circuit GDC1 and voltage fluctuations at the Q node of the first gate driving circuit GDC1 when the gate driving circuit 130 of FIG. 5 is used. FIG. 6B illustrates four gate signals (G(n+1), G(n+2), G(n+3), and G(n+4)) output from the first gate driving circuit GDC1 when the gate driving circuit 130 of FIG. 5 is used.

Referring to FIG. 5, the first gate driving circuit GDC1 can output four (m=4) gate signals (G(n+1), G(n+2), G(n+3), and G(n+4)) using four (m=4) clock signals (CLK(n+1), CLK(n+2), CLK(n+3), and CLK(n+4)) included in the first clock signal group CSG1. The second gate driving circuit GDC2 can output four (m=4) gate signals (G(n+5), G(n+6), G(n+7), and G(n+8)) using four (m=4) clock signals (CLK (n+5), CLK(n+6), CLK(n+7), and CLK(n+8)) included in the second clock signal group CSG2.

The first gate driving circuit GDC1 may include four (m=4) first output buffer circuits. The four first output buffer circuits may be electrically connected to correspond to four (m=4) gate lines GL. The four first output buffer circuits can output four (m=4) gate signals (G(n+1), G(n+2), G(n+3), and G(n+4)) to the four gate lines GL. Each of the four first output buffer circuits may include a pull-up transistor and a pull-down transistor.

The second gate driving circuit GDC2 may include four second output buffer circuits. The four second output buffer circuits may be electrically connected to correspond to four gate lines GL. The four second output buffer circuits can output four gate signals (G(n+5), G(n+6), G(n+7), and G(n+8)) to the four gate lines GL. Each of the four second output buffer circuits may include a pull-up transistor and a pull-down transistor.

Referring to FIGS. 5 and 6A, the four first output buffer circuits included in the first gate driving circuit GDC1 can share one Q node and one QB node.

The gate nodes of the respective pull-up transistors included in the four first output buffer circuits included in the first gate driving circuit GDC1 can share the one Q node. The gate nodes of the respective pull-down transistors included in the four first output buffer circuits included in the first gate driving circuit GDC1 can share the one QB node.

Referring to FIGS. 5, 6A, and 6B, for example, when the first gate driving circuit GDC1 performs 2H overlap gate driving, the first gate driving circuit GDC1 can receive four clock signals CLK(n+1), CLK(n+2), CLK(n+3), and CLK (n+4)) with a high level voltage duration corresponding to a period of 2H, and output four gate signals (G(n+1), G(n+2), G(n+3), and G(n+4)) with a turn-on level voltage duration corresponding to the period of 2H, The respective high level voltage durations of the four clock signals CLK(n+1), CLK(n+2), CLK(n+3), and CLK (n+4) may overlap in a predetermined or selected period (e.g., 1H). In turn, the respective turn-on level voltage durations of the four gate signals (G(n+1), G(n+2), G(n+3), and G(n+4)) may overlap in the predetermined or selected period (e.g., 1H).

Referring to FIGS. 5 and 6A, the first gate driving circuit GDC1 can sequentially receive four (m=4) clock signals (CLK(n+1), CLK(n+2), CLK(n+3), and CLK(n+4)) of which respective high level voltage durations partially overlap. Likewise, the second gate driving circuit GDC2 can sequentially receive four (m=4) clock signals (CLK(n+5), CLK(n+6), CLK(n+7), and CLK(n+8)) of which respective high level voltage durations partially overlap. Such a sequential clock input structure is referred to as a first clock input structure.

Referring to FIG. 6A, as the first gate driving circuit GDC1 has the Q node sharing structure and performs the overlap gate driving, one Q node shared by the four output buffer circuits may be greatly subject to respective voltage fluctuations (rising and falling) of the four clock signals (CLK(n+1), CLK(n+2), CLK(n+3), and CLK(n+4)), and there may therefore occur a step-like voltage fluctuation at the one Q node during a period after the first clock signal (CLK(n+1)) of the four clock signals (CLK(n+) 1), CLK (n+2), CLK(n+3), and CLK(n+4)) rises and before the last clock signal (CLK(n+4)) falls.

Referring to FIG. 6B, the voltage fluctuation characteristics at the Q node caused by the Q node sharing structure and overlapping gate driving may lead differences between respective output characteristics of four gate signals (G(n+1), G(n+2), G(n+3), and G(n+4)) to occur.

Referring to FIG. 6B, among the four gate signals (G(n+1), G(n+2), G(n+3), and G(n+4)), the (n+1)-th gate signal G(n+1) that is output based on the (n+1)-th clock signal CLK(n+1) firstly rising to a high level voltage has a longest rising time (rising period). That is, among the four gate signals (G(n+1), G(n+2), G(n+3), and G(n+4)), the (n+1)-th gate signal G(n+1) that is output based on the (n+1)-th clock signal CLK(n+1) firstly rising to the high level voltage has worst rising characteristics.

Referring to FIG. 6B, among the four gate signals (G(n+1), G(n+2), G(n+3), and G(n+4)), the (n+4)-th gate signal G(n+4) that is output based on the (n+4)-th clock signal CLK(n+4) lastly falling to a low level voltage has a longest falling time (falling period). That is, among the four gate signals (G(n+1), G(n+2), G(n+3), and G(n+4)), the (n+4)-th gate signal G(n+4) that is output based on the (n+4)-th clock signal CLK(n+4) lastly falling to the low level voltage has worst falling characteristics.

Such gate signal output characteristic differences (a rising characteristic difference, and a falling characteristic difference) may cause an image abnormal situation in which an abnormal horizontal line is viewed on the screen of the display device 100 at points where the differences occurs.

The operation and image abnormal situation with respect to the first gate driving circuit GDC1 with reference to FIGS. 6A and 6B which have been described for convenience of description can be repeated, mutatis mutandis, with respect to the second gate driving circuit GDC2.

The Q node voltage fluctuation characteristics caused by the Q node sharing structure and overlapping gate driving and the resulting gate signal output characteristic differences (the rising characteristic difference, and the falling characteristic difference) are attributed to the first clock input structure (that is, the sequential clock input structure).

Hereinafter, to address this issue, discussions will be given on a second clock input structure capable of reducing such gate signal output characteristic differences (the rising characteristic difference, and the falling characteristic difference) even when the Q node sharing structure and overlap gate driving are performed, and the gate driving circuit 130 using the second clock input structure and the display device 100 including gate driving circuit 130.

Figure 7A:
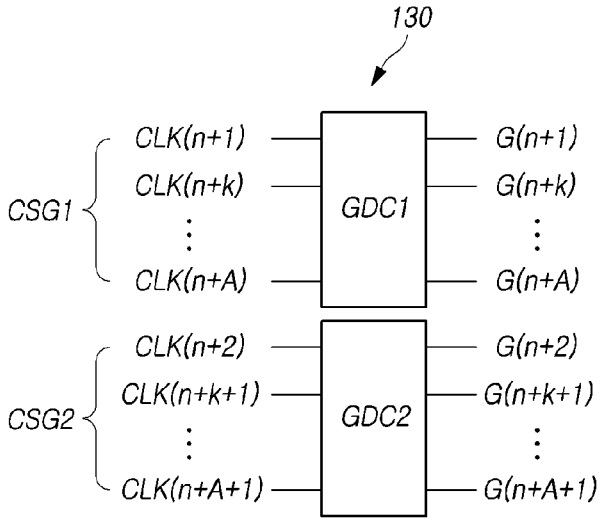
FIG. 7A illustrates a gate driving circuit having a second clock input structure included in the display device according to an embodiments of the present disclosure.
Figure 7B:
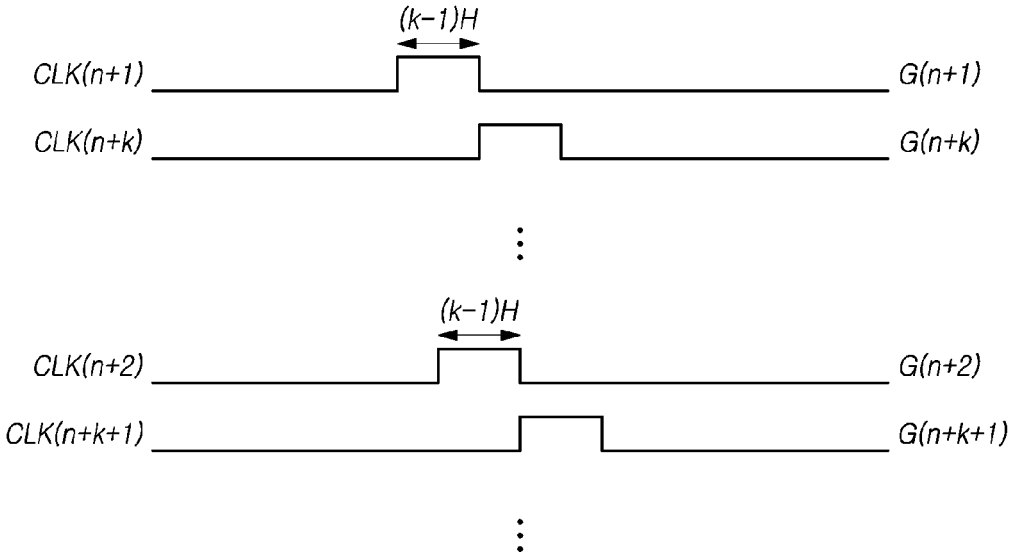
FIG. 7B illustrates clock signals input to the gate driving circuit illustrated in FIG. 7A.
Figure 8:
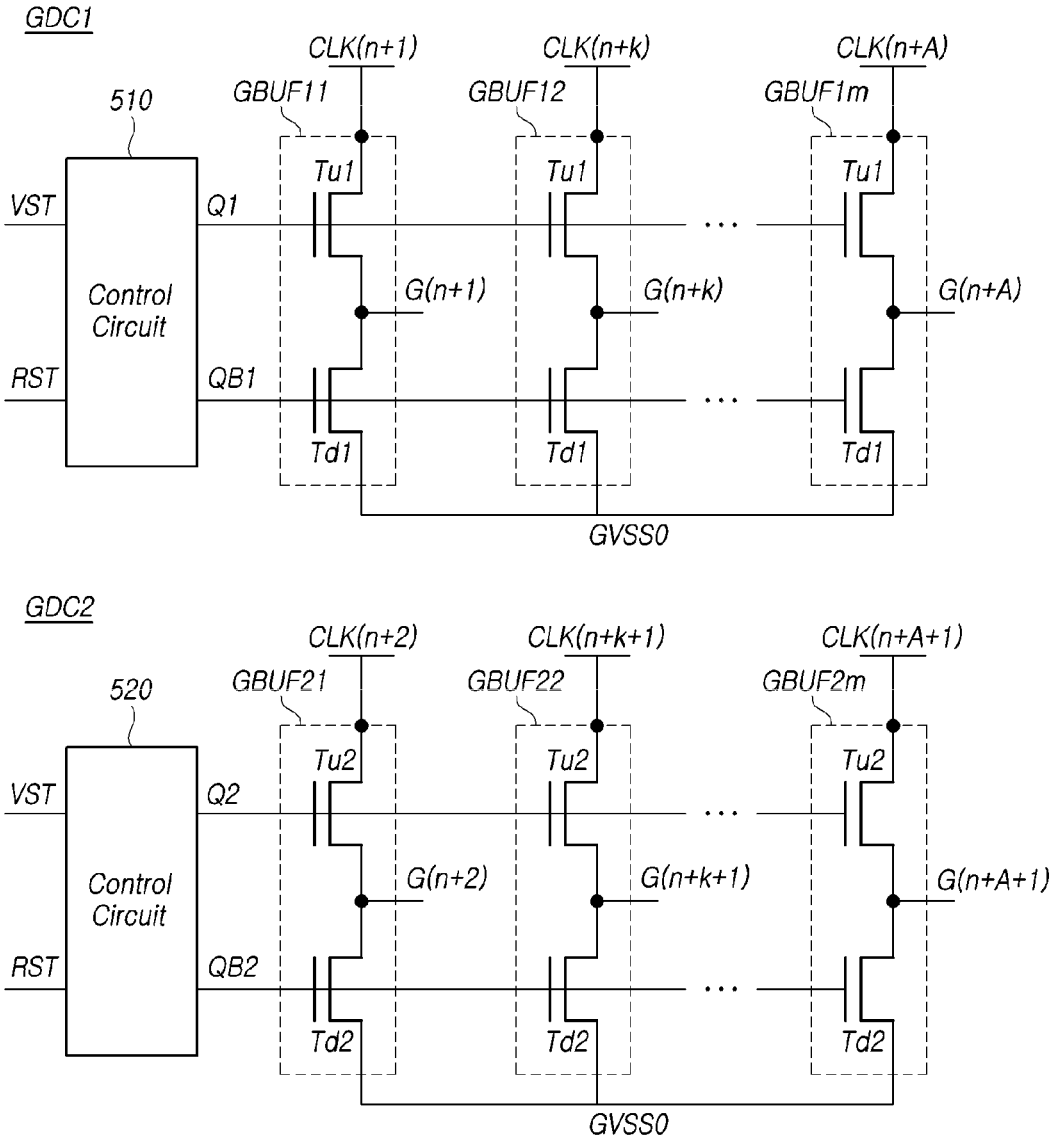
FIG. 8 illustrates the gate driving circuit illustrated in FIG. 7A in more detail.

FIG. 7A illustrates a gate driving circuit 130 having the second clock input structure included in the display device 100 according to an embodiments of the present disclosure. FIG. 7B illustrates clock signals input to the gate driving circuit 130 illustrated in FIG. 7A. FIG. 8 illustrates the gate driving circuit 130 illustrated in FIG. 7A in more detail.

Referring to FIG. 7A, the gate driving circuit 130 having the second clock input structure included in the display device 100 according to an embodiments of the present disclosure may include a first gate driving circuit GDC1 capable of outputting m number of gate signals (G(n+1), G(n+k), . . . , G(n+A)) using a first clock signal group CSG1, and a second gate driving circuit GDC2 capable of outputting m number of gate signals (G(n+2), G(n+k+1), . . . , G(n+A+1)) using a second clock signal group CSG2 different from the first clock signal group CSG1, where n is any integer, and m is a natural number of 2 or more. Here, A represents a value of the mth term of an arithmetic progression with an initial term of 1 and a common difference of (k−1) (i.e., increasing by (k−1), and is then given by 1+(m−1)(k−1). The (k−1) is not 1 and a natural number greater than or equal to 2. The second clock input structure is also referred to as a non-sequential clock input structure.

Referring to FIG. 7A, in the second clock input structure, the first clock signal group CSG1 input to the first gate driving circuit GDC1 may include m number of clock signals (CLK(n+1), CLK(n+k)), . . . , CLK(n+A)), and the second clock signal group CSG2 input to the second gate driving circuit GDC2 may include m number of clock signals (CLK(n+2), CLK(n+k+1), . . . , CLK(n+A+1)). Meanwhile, in the first clock input structure of FIG. 5, the first clock signal group CSG1 input to the first gate driving circuit GDC1 may include 4 (m=4) sequential clock signals (CLK(n+1), CLK(n+2), CLK(n+3), and CLK(n+4)), and the second clock signal group CSG2 input to the second gate driving circuit GDC2 may include 4 (m=4) sequential clock signals (CLK(n+5), CLK(n+6), CLK(n+7), and CLK(n+8)).

As described above, the clock signals included in the first clock signal group CSG1 input to the first gate driving circuit GDC1 in the second clock input structure and the clock signals included in the first clock signal group CSG1 input to the first gate driving circuit GDC1 in the first clock input structure may be different from each other. Likewise, the clock signals included in the second clock signal group CSG2 input to the second gate driving circuit GDC2 in the second clock input structure and the clock signals included in the second clock signal group CSG2 input to the second gate driving circuit GDC2 in the first clock input structure may be different from each other. Here, "first" in the first clock signal group CSG1 and "second" in the second clock signal group CSG2 may correspond to "first" in the first gate driving circuit GDC1 and "second" in the second gate driving circuit (GDC2), respectively.

2 m number of clock signals including n number of clock signals (CLK(n+1), CLK(n+k), . . . , CLK(n+A)) included in the first clock signal group CSG1 and m number of clock signals ((CLK(n+2), CLK(n+k+1), . . . , CLK(n+A+1)) included in the second clock signal group CSG2 may have high level voltage durations at timings different from one another. That is, all of the 2 m number of clock signals may be different clock signals.

Referring to FIG. 8, the first gate driving circuit GDC1 may include m number of first output buffer circuits (GBUF11, GBUF12, . . . , GBUF1*m*) capable of receiving m number of clock signals (CLK(n+1), CLK(n+k), . . . , CLK(n+A)) and outputting m number of gate signals (G(n+1), G(n+k), . . . , G(n+A)), and a first control circuit 510 capable of controlling the m number of first output buffer circuits (GBUF11, GBUF12, . . . , GBUF1*m*).

The first control circuit 510 can receive a start signal VST, a reset signal RST, and the like, and control the operations of the m number of first output buffer circuits (GBUF11, GBUF12, . . . , GBUF1*m*).

Referring to FIG. 8, the second gate driving circuit GDC2 may include m number of second output buffer circuits (GBUF21, GBUF22, . . . , GBUF2*m*) capable of receiving m number of clock signals (CLK(n+2), CLK(n+k+1), . . . , CLK(n+A+1)) and outputting m number of gate signals (G(n+2), G(n+k+1), . . . , G(n+A+1)), and a second control circuit 520 capable of controlling the m number of second output buffer circuits (GBUF21, GBUF22, . . . , GBUF2*m*).

The second control circuit 520 can receive a start signal VST, a reset signal RST, and the like, and control the operations of the m number of second output buffer circuits (GBUF21, GBUF22, . . . , GBUF2*m*).

Referring to FIG. 8, each of the m number of first output buffer circuits (GBUF11, GBUF12, . . . , GBUF1*m*) may include a pull-up transistor Tu1 and a pull-down transistor Td1. The pull-up transistor Tu1 and the pull-down transistor Td1 may be connected in series between a node to which a corresponding clock signal is applied and a node to which a base voltage GVSSO is applied. A point where the pull-up transistor Tu1 and the pull-down transistor Td1 are connected is a point to which a corresponding gate line is connected and from which a corresponding gate signal is output. All the gate nodes of the respective pull-up transistor Tu1 included in the m number of first output buffer circuits (GBUF11, GBUF12, . . . , GBUF1*m*) may be electrically connected to one first Q node Q1, and all the gate nodes of the respective pull-down transistors Td1 included in the m number of first output buffer circuits (GBUF11, GBUF12, . . . , GBUF1*m*) may be electrically connected to one first QB node QB1.

Referring to FIG. 8, each of the m number of second output buffer circuits (GBUF21, GBUF22, . . . , GBUF2*m*) may include a pull-up transistor Tu2 and a pull-down transistor Td2. The pull-up transistor Tu2 and the pull-down transistor Td2 may be connected in series between a node to which a corresponding clock signal is applied and a node to which a base voltage GVSSO is applied. A point where the pull-up transistor Tu2 and the pull-down transistor Td2 are connected is a point to which a corresponding gate line is connected and a corresponding gate signal is output. All the gate nodes of the respective pull-up transistor Tu2 included in the m number of second output buffer circuits (GBUF21, GBUF22, . . . , GBUF2*m*) may be electrically connected to one second Q node Q2, and all the gate nodes of the respective pull-down transistors Td2 included in the m number of second output buffer circuits (GBUF21, GBUF22, . . . , GBUF2*m*) may be electrically connected to one second QB node QB2.

Referring to FIG. 8, m number of clock signals (CLK(n+1), CLK(n+k), . . . , CLK(n+A)) input to the m number of first output buffer circuits (GBUF11, GBUF12, . . . , GBUF1*m*) of the first gate driving circuit GDC1 may include an (n+1)-th clock signal CLK(n+1)) and an (n+k)-th clock signal CLK(n+k).

Referring to FIG. 8, m number of clock signals (CLK(n+2), CLK(n+k+1), . . . , CLK(n+A+1)) input to the m number of second output buffer circuits (GBUF21, GBUF22, . . . , GBUF2*m*) of the second gate driving circuit GDC2 may include an (n+2)-th clock signal CLK(n+2)) and an (n+k+1)-th clock signal CLK(n+k+1). Here, n is any integer, k is a natural number of 3 or more.

Referring to FIG. 7B, the gate driving circuit 130 can perform (k−1)H overlap gate driving. As a result, a high level voltage duration of the (n+1)-th clock signal CLK(n+1) input to the first gate driving circuit GDC1 and a high level voltage duration of the (n+2)-th clock signal CLK(n+2) input to the second gate driving circuit GDC2 may partially overlap each other. A high level voltage duration of the (n+k)-th clock signal CLK(n+k) input to the first gate driving circuit GDC1 and a high level voltage duration of the (n+k+1)-th clock signal CLK(n+k+1) input to the second gate driving circuit GDC2 may partially overlap each other.

Referring to FIG. 7B, respective high level voltage durations of the m number of clock signals (CLK(n+1), CLK(n+k), . . . , CLK(n+A)) input to the m number of first output buffer circuits (GBUF11, GBUF12, . . . , GBUF1*m*) of the first gate driving circuit GDC1 may not overlap one another. Likewise, respective high level voltage durations of the m number of clock signals (CLK(n+2), CLK(n+k+1), . . . , CLK(n+A+1)) input to the m number of second output buffer circuits (GBUF21, GBUF22, . . . , GBUF2*m*) of the second gate driving circuit GDC2 may not overlap one another.

For example, the high level voltage duration of the (n+1)-th clock signal CLK(n+1) and the high level voltage duration of the (n+k)-th clock signal CLK(n+k) may not overlap each other. Further, the high level voltage duration of the (n+2)-th clock signal CLK(n+2) and the high level voltage duration of the (n+k+1)-th clock signal CLK(n+k+1) may not overlap each other.

Referring to FIGS. 7A, 7B, and 8, the first gate driving circuit can output an (n+1)-th gate signal G(n+1) based on the (n+1)-th clock signal CLK(n+1), and output an (n+k)-th gate signal G(n+k) based on the (n+k)-th clock signal CLK(n+k). The second gate driving circuit can output an (n+2)-th gate signal G(n+2) based on the (n+2)-th clock signal CLK(n+2), and output an (n+k+1)-th gate signal G(n+k+1) based on the (n+k+1)-th clock signal CLK(n+k+1).

Referring to FIG. 7B, the turn-on level voltage duration of the (n+1)-th gate signal G(n+1) may partially overlap the turn-on level voltage duration of the (n+2)-th gate signal G(n+2). In contrast, the turn-on level voltage duration of the (n+1)-th gate signal G(n+1) may not overlap the turn-on level voltage duration of the (n+k)-th gate signal G(n+k).

Referring to FIG. 7B, the turn-on level voltage duration of the (n+2)-th gate signal G(n+2) may partially overlap the turn-on level voltage duration of the (n+1)-th gate signal G(n+1). In contrast, the turn-on level voltage duration of the (n+2)-th gate signal G(n+2) may not overlap the turn-on level voltage duration of the (n+k+1)-th gate signal G(n+k+1).

In the above discussions, m may be the number of first output buffer circuits sharing one first Q node, or the number of pull-up transistors whose gate nodes are commonly connected to the one first Q node. Further, m may be the number of second output buffer circuits sharing one second Q node, or the number of pull-up transistors whose gate nodes are commonly connected to the one second Q node.

In the above discussions, k is proportional to a length of a high level voltage duration of each clock signal, and a value obtained by multiplying one horizontal period H by (k−1) equals to a length ((k−1)*H) of a high level voltage duration of each clock signal. For example, k may be 3, 4, 5, or the like, and a high level voltage duration of each clock signal may have a length of 2H, 3H, 4H, or the like. Hereinafter, in the case of m=4 and k=3, the gate driving circuit 130 having the second clock input structure will be described.

Figure 9:
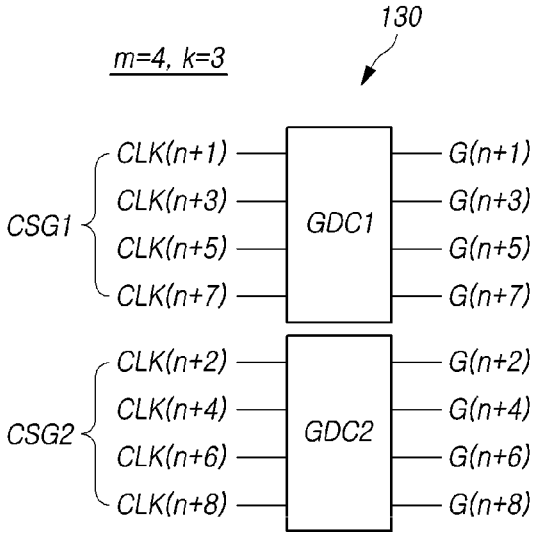
FIG. 9 illustrates an example of the gate driving circuit illustrated in FIG. 7A.
Figure 10:
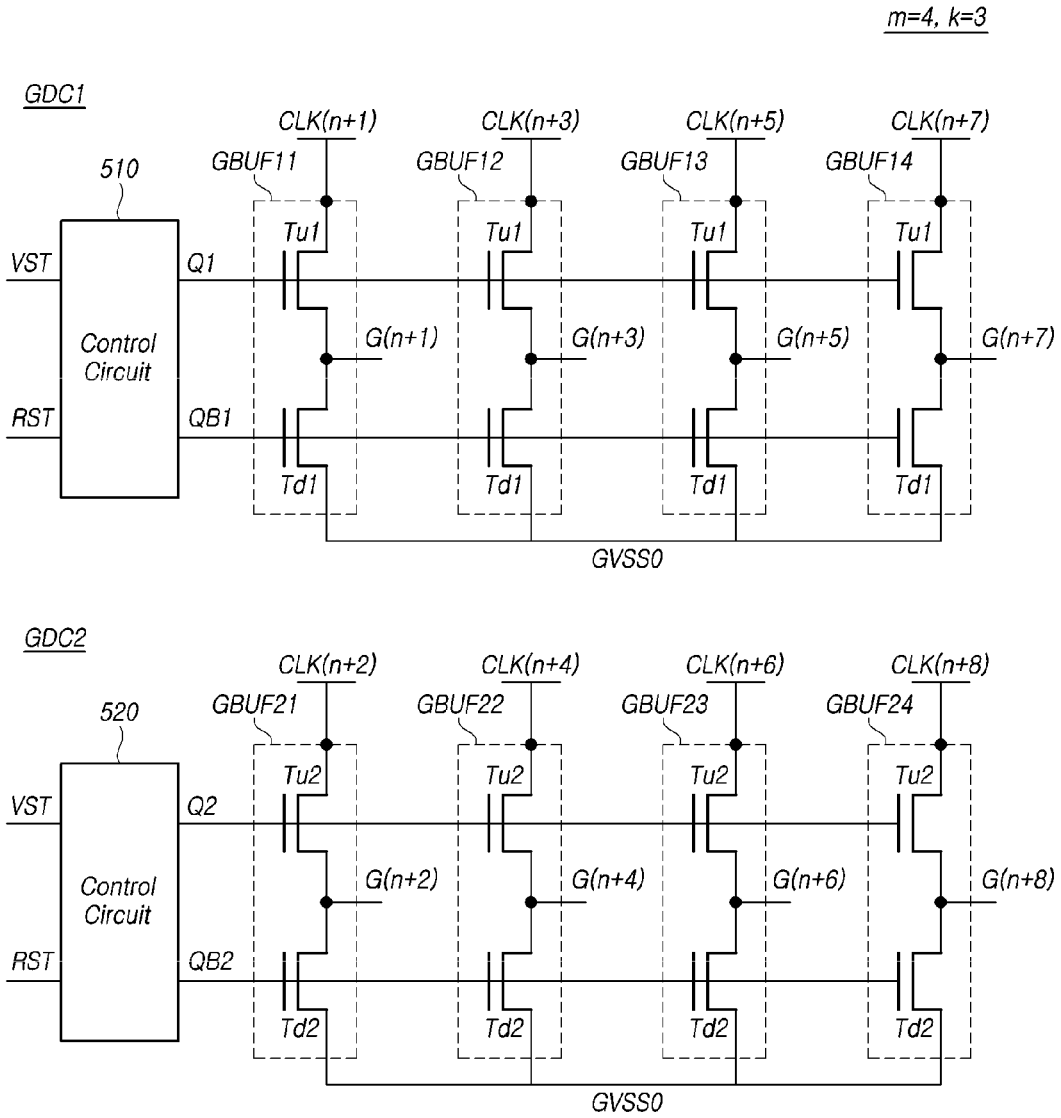
FIG. 10 illustrates the gate driving circuit illustrated in FIG. 9 in more detail.
Figure 11A:
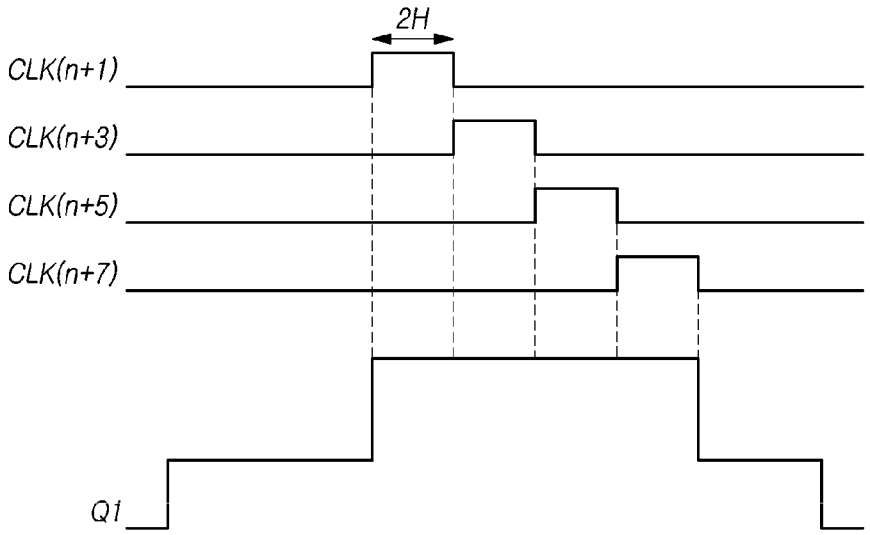
FIG. 11A illustrates 4 clock signals input to a first gate driving circuit when the gate driving circuit illustrated in FIG. 9 is used, and voltage fluctuations at a Q1 node of the first gate driving circuit.
Figure 11B:
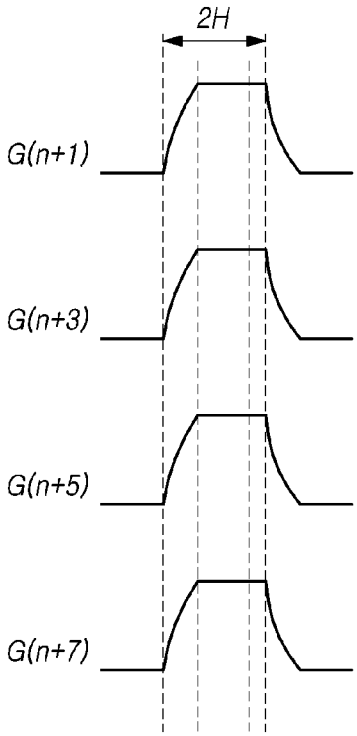
FIG. 11B illustrates 4 gate signals output from the first gate driving circuit when the gate driving circuit illustrated in FIG. 9 is used.
Figure 11C:
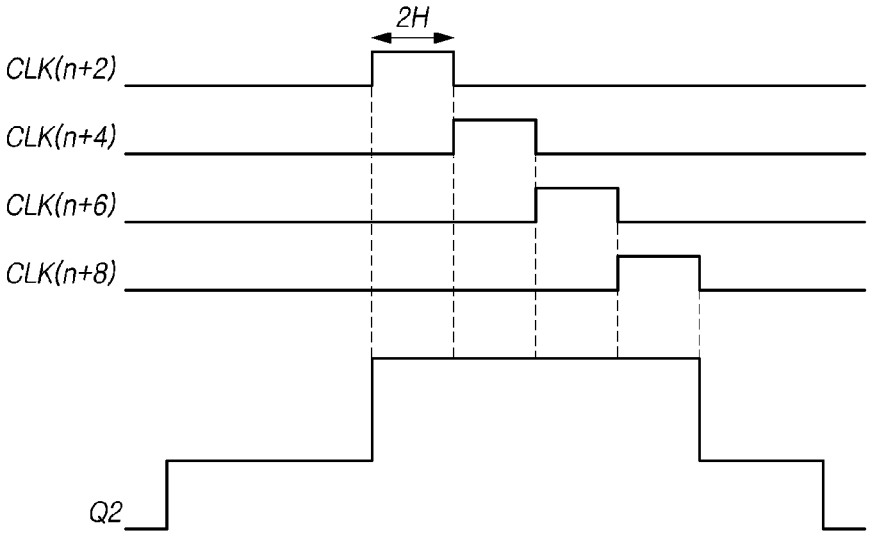
FIG. 11C illustrates 4 clock signals input to a second gate driving circuit when the gate driving circuit illustrated in FIG. 9 is used, and voltage fluctuations at a Q2 node of the second gate driving circuit.
Figure 11D:
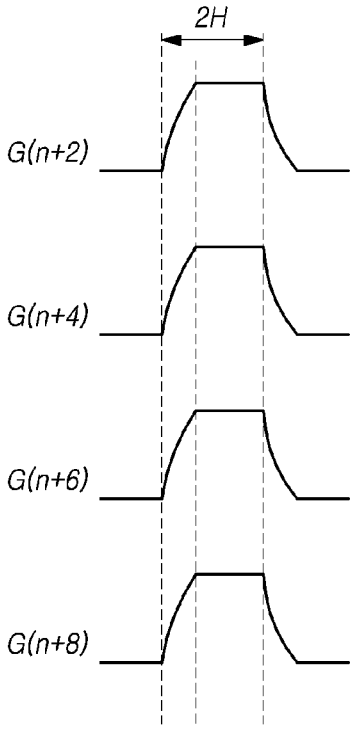
FIG. 11D illustrates 4 gate signals output from the second gate driving circuit when the gate driving circuit illustrated in FIG. 9 is used.

FIG. 9 illustrates an example of the gate driving circuit 130 illustrated in FIG. 7A. FIG. 10 illustrates the gate driving circuit 130 illustrated in FIG. 9 in more detail. FIG. 11A illustrates four clock signals input to the first gate driving circuit GDC1 when the gate driving circuit 130 illustrated in FIG. 9 is used, and voltage fluctuations at the Q1 node of the first gate driving circuit GDC1. FIG. 11B illustrates four gate signals output from the first gate driving circuit GDC1 when the gate driving circuit 130 illustrated in FIG. 9 is used. FIG. 11C illustrates four clock signals input to the second gate driving circuit GDC2 when the gate driving circuit 130 illustrated in FIG. 9 is used, and voltage fluctuations at the Q2 node of the second gate driving circuit GDC2. FIG. 11D illustrates four gate signals output from the second gate driving circuit GDC2 when the gate driving circuit 130 illustrated in FIG. 9 is used. FIGS. 9 to 11D are examples of the gate driving circuit 130 in the case of k=3 and m=4. Here, k=3 means that 2H overlap gate driving is performed, and m=4 means that the number of output buffer circuits sharing a Q node is 4.

Referring to FIGS. 9 and 10, in the case of m=4 and k=3, four first output buffer circuits (GBUF11, GBUF12, GBUF13, and GBUF14) included in the first gate driving circuit GDC1 may include a first output buffer circuit GBUF11 capable of receiving an (n+1)-th clock signal CLK(n+1) and outputting an (n+1)-th gate signal G(n+1) based on the (n+1)-th clock signal CLK(n+1), a first output buffer circuit GBUF12 capable of receiving an (n+3)-th clock signal CLK(n+3) and outputting an (n+3)-th gate signal G(n+3) based on the (n+3)-th clock signal CLK(n+3), a first output buffer circuit GBUF13 capable of receiving an (n+5)-th clock signal CLK(n+5) and outputting an (n+5)-th gate signal G(n+5) based on the (n+5)-th clock signal CLK(n+5), and a first output buffer circuit GBUF14 capable of receiving an (n+7)-th clock signal CLK(n+7) and outputting an (n+7)-th gate signal G(n+7) based on the (n+7)-th clock signal CLK(n+7).

Referring to FIG. 10, each of the four first output buffer circuits (GBUF11, GBUF12, GBUF13, and GBUF14) may include a pull-up transistor Tu1 and a pull-down transistor Td1. The pull-up transistor Tu1 and the pull-down transistor Td1 may be connected in series between a node to which a corresponding clock signal is applied and a node to which a base voltage GVSSO is applied. A point where the pull-up transistor Tu1 and the pull-down transistor Td1 are connected is a point to which a corresponding gate line is connected and a corresponding gate signal is output. All the gate nodes of the respective pull-up transistor Tu1 included in the four first output buffer circuits (GBUF11, GBUF12, GBUF13, and GBUF14) may be electrically connected to one first Q node Q1, and all the gate nodes of the respective pull-down transistors Td1 included in the four first output buffer circuits (GBUF11, GBUF12, GBUF13, and GBUF14) may be electrically connected to one first QB node QB1.

Referring to FIG. 10, a first control circuit 510 can receive a start signal VST, a reset signal RST, and the like, and control the operations of the four first output buffer circuits (GBUF11, GBUF12, GBUF13, and GBUF14).

Referring to FIGS. 9 and 10, in the case of m=4 and k=3, four second output buffer circuits (GBUF21, GBUF22, GBUF23, and GBUF24) included in the second gate driving circuit GDC2 may include a second output buffer circuit GBUF21 capable of receiving an (n+2)-th clock signal CLK(n+2) and outputting an (n+2)-th gate signal G(n+2) based on the (n+2)-th clock signal CLK(n+2), a second output buffer circuit GBUF22 capable of receiving an (n+4)-th clock signal CLK(n+4) and outputting an (n+4)-th gate signal G(n+4) based on the (n+4)-th clock signal CLK(n+4), a second output buffer circuit GBUF23 capable of receiving an (n+6)-th clock signal CLK(n+6) and outputting an (n+6)-th gate signal G(n+6) based on the (n+6)-th clock signal CLK(n+6), and a second output buffer circuit GBUF24 capable of receiving an (n+8)-th clock signal CLK(n+8) and outputting an (n+8)-th gate signal G(n+8) based on the (n+8)-th clock signal CLK(n+8).

Referring to FIG. 10, each of the four second output buffer circuits (GBUF21, GBUF22, GBUF23, and GBUF24) may include a pull-up transistor Tu2 and a pull-down transistor Td2. The pull-up transistor Tu2 and the pull-down transistor Td2 may be connected in series between a node to which a corresponding clock signal is applied and a node to which a base voltage GVSSO is applied. A point where the pull-up transistor Tu2 and the pull-down transistor Td2 are connected is a point to which a corresponding gate line is connected and a corresponding gate signal is output. All the gate nodes of the respective pull-up transistor Tu2 included in the second output buffer circuits (GBUF21, GBUF22, GBUF23, and GBUF24) may be electrically connected to one second Q node Q2, and all the gate nodes of the respective pull-down transistors Td2 included in the four second output buffer circuits (GBUF21, GBUF22, GBUF23, and GBUF24) may be electrically connected to one second QB node QB2.

Referring to FIG. 10, a second control circuit 520 can receive a start signal VST, a reset signal RST, and the like, and control the operations of the four second output buffer circuits (GBUF21, GBUF22, GBUF23, and GBUF24).

Referring to FIG. 11A, the first gate driving circuit GDC1 has the second clock input structure. Accordingly, the respective high level voltage durations of the (n+1)-th clock signal CLK(n+1)), (n+3)-th clock signal (CLK(n+3)), (n+5)-th clock signal (CLK(n+5)), and (n+7)-th clock signal (CLK(n+7)), which are input to the four first output buffer circuits (GBUF11, GBUF12, GBUF13, and GBUF14) included in the first gate driving circuit GDC1, may not overlap one another even when the high level voltage durations have a period of 2H.

Accordingly, the first Q node Q1 shared by the four first output buffer circuits (GBUF11, GBUF12, GBUF13, and GBUF14) may not significantly subject to the respective voltage fluctuations (rising and falling) of the four clock signals (CLK(n+1), CLK(n+3), CLK(n+5) and CLK(n+7)). That is, a voltage of the first Q node Q1 can rise as the first clock signal CLK(n+1) of the four clock signals (CLK(n+1), CLK(n+3), CLK(n+5), CLK(n+7)) rises, and the voltage of the first Q node Q1 can fall as the last clock signal CLK(n+7) of the four clock signals (CLK(n+1), CLK(n+3), CLK(n+5), CLK(n+7)) falls. During a period between a rising time of the first clock signal CLK(n+1) and a falling time of the last clock signal CLK(n+7), the first Q node Q1 remains at a constant voltage, and thus, a large voltage fluctuation such as a step-like voltage fluctuation is not produced.

Accordingly, referring to FIG. 11B, the respective rising characteristics (rising periods) and falling characteristics (falling periods) of four gate signals (G(n+1), G(n+3), G(n+5), G(n+7)) output from the four first output buffer circuits (GBUF11, GBUF12, GBUF13, and GBUF14) included in the first gate driving circuit GDC1 may be substantially, or nearly, equal, or similar to one another. That is, although the first gate driving circuit GDC1 performs the overlapping gate driving and has the Q node sharing structure, the second clock input structure applied to the first gate driving circuit GDC1 enables output characteristic differences (a rising characteristic difference and a falling characteristic difference) of gate signals to be reduced.

Referring to FIG. 11C, the second gate driving circuit GDC2 has the second clock input structure. Accordingly, the respective high level voltage durations of the (n+2)-th clock signal CLK(n+2)), (n+4)-th clock signal (CLK(n+4)), (n+6)-th clock signal (CLK(n+6)), and (n+8)-th clock signal (CLK (n+8)), which are input to the four second output buffer circuits (GBUF21, GBUF22, GBUF23, and GBUF24) included in the second gate driving circuit GDC2, may not overlap one another even when the high level voltage durations have a period of 2H.

Accordingly, the second Q node Q2 shared by the four first output buffer circuits (GBUF21, GBUF22, GBUF23, and GBUF24) may not significantly subject to the respective voltage fluctuations of the four clock signals (CLK(n+2), CLK(n+4), CLK(n+6) and CLK(n+8)). That is, there is not nearly produced a step-like voltage fluctuation at the second Q node Q2 shared by the four second output buffer circuits (GBUF21, GBUF22, GBUF23, and GBUF24) during a period after the first clock signal (CLK(n+2)) of the four clock signals (CLK(n+2), CLK(n+4), CLK(n+6) and CLK (n+8)) rises and before the last clock signal (CLK(n+8)) falls.

Accordingly, referring to FIG. 11D, the respective rising characteristics (rising periods) and falling characteristics (falling periods) of four gate signals (G(n+2), G(n+4), G(n+6), G(n+8)) output from the four second output buffer circuits (GBUF21, GBUF22, GBUF23, and GBUF24) included in the second gate driving circuit GDC2 may be substantially, or nearly, equal, or similar to one another. That is, although the second gate driving circuit GDC2 performs the overlapping gate driving and has the Q node sharing structure, the second clock input structure applied to the second gate driving circuit GDC2 enables output characteristic differences (a rising characteristic difference and a falling characteristic difference) of gate signals to be reduced.

Figure 12:
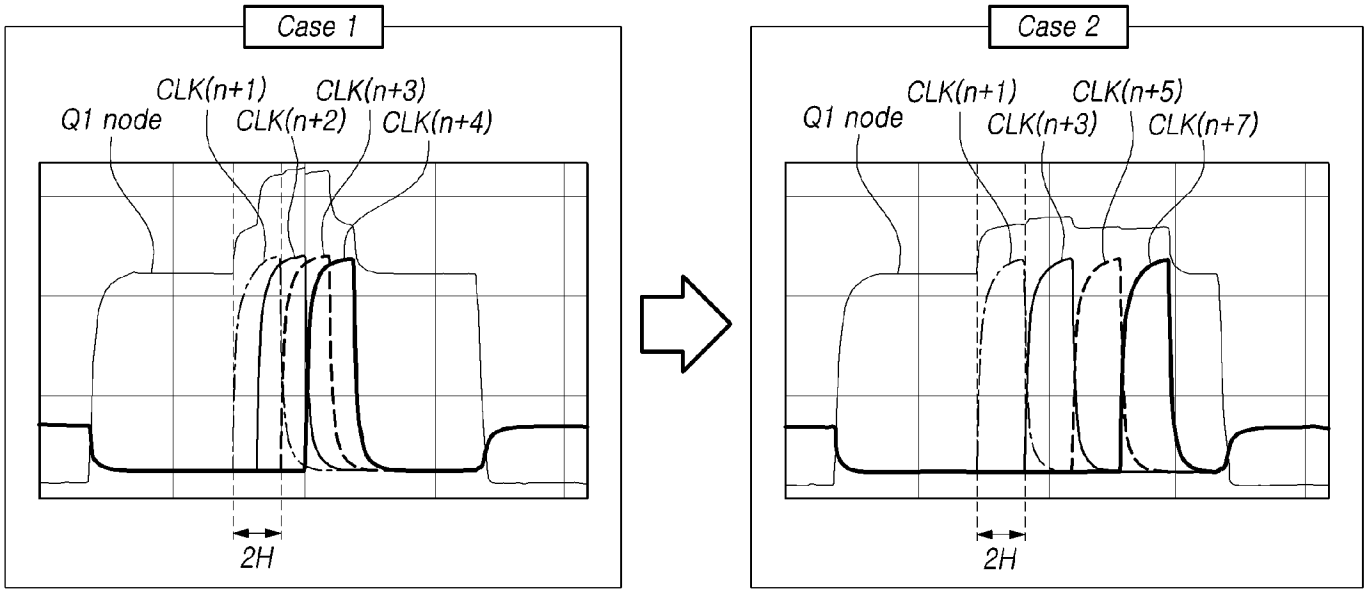
FIG. 12 illustrates a result from a simulation for detecting output characteristics for each of the first clock input structure and the second clock input structure used in the gate driving circuit of the display device according to an embodiments of the present disclosure.

FIG. 12 illustrates that respective cases (Case 1 and Case 2) in which the gate driving circuit 130 of the display device 100 according to an embodiments of the present disclosure has the first clock input structure and the second clock input structure.

Referring to FIG. 12, when the first gate driving circuit GDC1 has the first clock input structure (Case 1), the first gate driving circuit GDC1 can receive four sequential clock signals (CLK(n+1), CLK(n+2), CLK(n+3), and CLK(n+4)).

When k defining (e.g., representing) a characteristic of the overlap gate driving is 3, the respective high level voltage durations of the four clock signals (CLK(n+1), CLK(n+2), CLK(n+3), and CLK(n+4)) input to the first gate driving circuit GDC1 have a period of 2H. The high level voltage duration of the (n+1)-th clock signal CLK(n+1) and the high level voltage duration of the (n+2)-th clock signal CLK(n+2) may partially overlap, the high level voltage duration of the (n+2)-th clock signal CLK(n+2) and the high level voltage duration of the (n+3)-th clock signal CLK(n+3) may partially overlap, and the high level voltage duration of the (n+3)-th clock signal CLK(n+3) and the high level voltage duration of the (n+4)-th clock signal CLK(n+4) may partially overlap.

When the gate driving circuit 130 has the first clock input structure (Case 1), the first Q node Q1 in the first gate driving circuit GDC1 may significantly subject to the four clock signals (CLK(n+1), CLK(n+2), CLK(n+3), and CLK (n+4)) whose respective high level voltage durations partially overlap one another. Therefore, this may lead voltage fluctuations to be severely produced, and in turn, lead differences in output characteristics of corresponding gate signals (G(n+1), G(n+2), G(n+3), and G(n+4)) to increase.

Referring to FIG. 12, when the first gate driving circuit GDC1 has the second clock input structure (Case 2), the first gate driving circuit GDC1 can receive four non-sequential clock signals (CLK(n+1), CLK(n+3), CLK(n+5), and CLK (n+7)). Here, the non-sequencing of the clock signals (e.g., CLK(n+1), CLK(n+3), CLK(n+5), CLK(n+7)) may mean that durations between start times (rising times) of the respective high level voltage durations of the clock signals (e.g., (CLK(n+1), CLK(n+3), CLK(n+5), CLK(n+7)) do not have a period of 1H. In contrast, clock signals (e.g., CLK (n+1), CLK(n+2), CLK(n+3), and CLK(n+4)) in FIG. 6A are defined as being sequential, which may mean that durations between start times (rising times) of the clock signals (e.g., CLK(n+1), CLK(n+2), CLK(n+3), and CLK (n+4)) have a period of 1H.

When k defining (e.g., representing) a characteristic of the overlap gate driving is 3, the respective high level voltage durations of the four clock signals (CLK(n+1), CLK(n+3), CLK(n+5), and CLK(n+7)) input to the first gate driving circuit GDC1 have a period of 2H and do not overlap one another.

When the gate driving circuit 130 has the second clock input structure (Case 2), the first Q node Q1 in the first gate driving circuit GDC1 may not significantly subject to the four clock signals (CLK(n+1), CLK(n+3), CLK(n+5), and CLK(n+7)) whose respective high level voltage durations do not overlap one another. Therefore, differences in output characteristics of corresponding gate signals (G(n+1), G(n+3), G(n+5), and G(n+4)) can be reduced.

Figure 13:
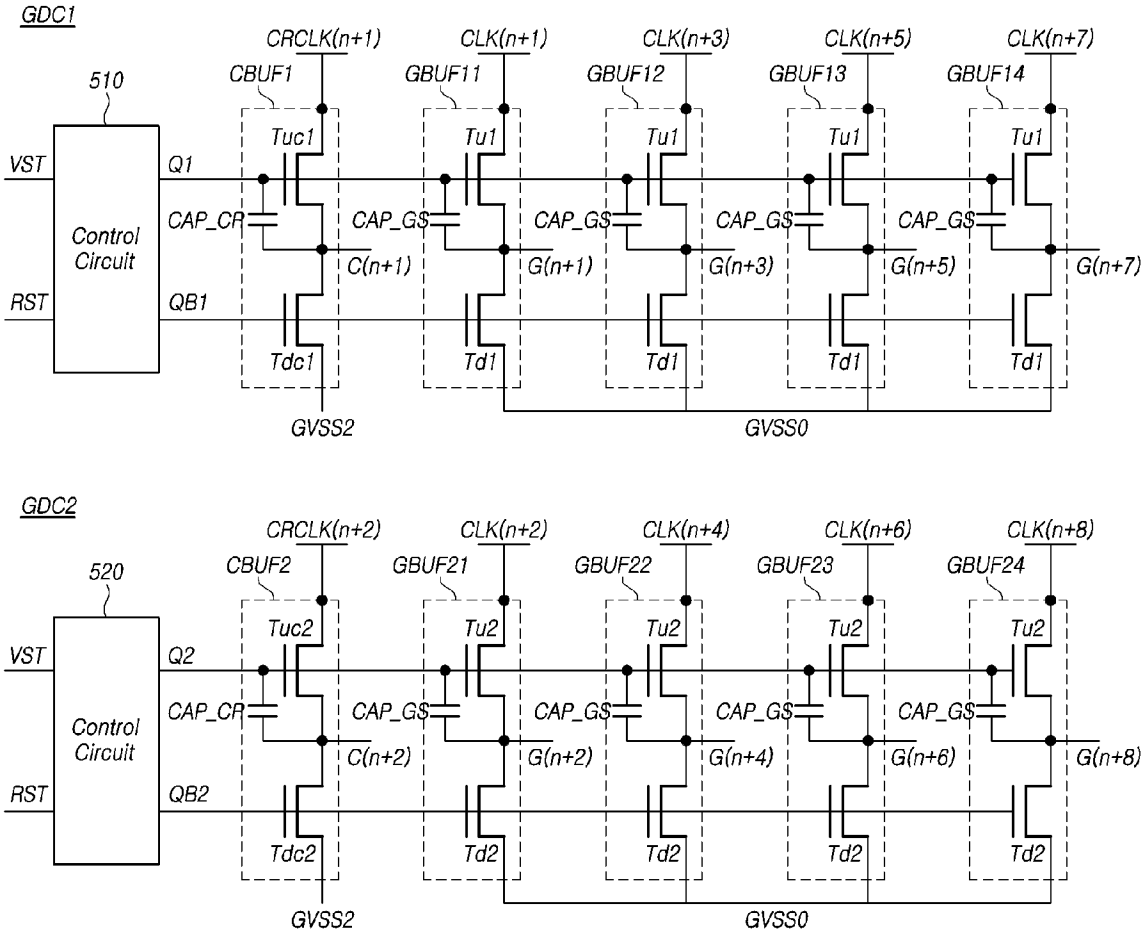
FIG. 13 illustrates an example implementation of the gate driving circuit illustrated in FIG. 10.

FIG. 13 illustrates an example implementation of the gate driving circuit 130 illustrated in FIG. 10.

FIG. 13 illustrates a configuration resulting from partially modifying the gate driving circuit 130 of FIG. 10, and thus, for convenience of description, discussions on equal elements and operations will be omitted.

Referring to FIG. 13, the first gate driving circuit GDC1 may further include a first carry output buffer circuit CBUF1 capable of receiving an (n+1)-th carry clock signal CRCLK (n+1) and outputting a carry signal C(n+1), and the second gate driving circuit GDC2 may further include a second carry output buffer circuit CBUF2 capable of receiving an (n+2)-th carry clock signal CRCLK(n+2) and outputting a carry signal C(n+2).

The first carry output buffer circuit CBUF1 may include a pull-up transistor Tuc1 and a pull-down transistor Tdc1 that are connected in series between a node to which the (n+1)-th carry clock signal CRCLK(n+1) is input and a node to which a base voltage GVSS2 is applied. The second carry output buffer circuit CBUF2 may include a pull-up transistor Tuc2 and a pull-down transistor Tdc2 that are connected in series between a node to which the (n+2)-th carry clock signal CRCLK(n+2) is input and a node to which the base voltage GVSS2 is applied.

Referring to FIG. 13, capacitors CAP_GS and CAP_CR may be connected between gates node and source nodes (nodes from which a gate signal or a carry signal is output) of the pull-up transistors (Tu1, Tuc1, Tu2, and Tuc2).

Hereinafter, discussions will be conducted on how gate signals (G(n+1) to G(n+8)) output from the gate driving circuit 130 of FIGS. 9 and 10 are supplied to gate lines GL(n+1) to GL (n+8)). That is, a structure in which the eight output buffer circuits (GBUF11, GBUF12, GBUF13, GBUF14, GBUF21 GBUF22, GBUF23, and GBUF24) are connected with the eight gate lines (GL(n+1) to GL(n+8)) in FIG. 10 will be described.

Figure 14:
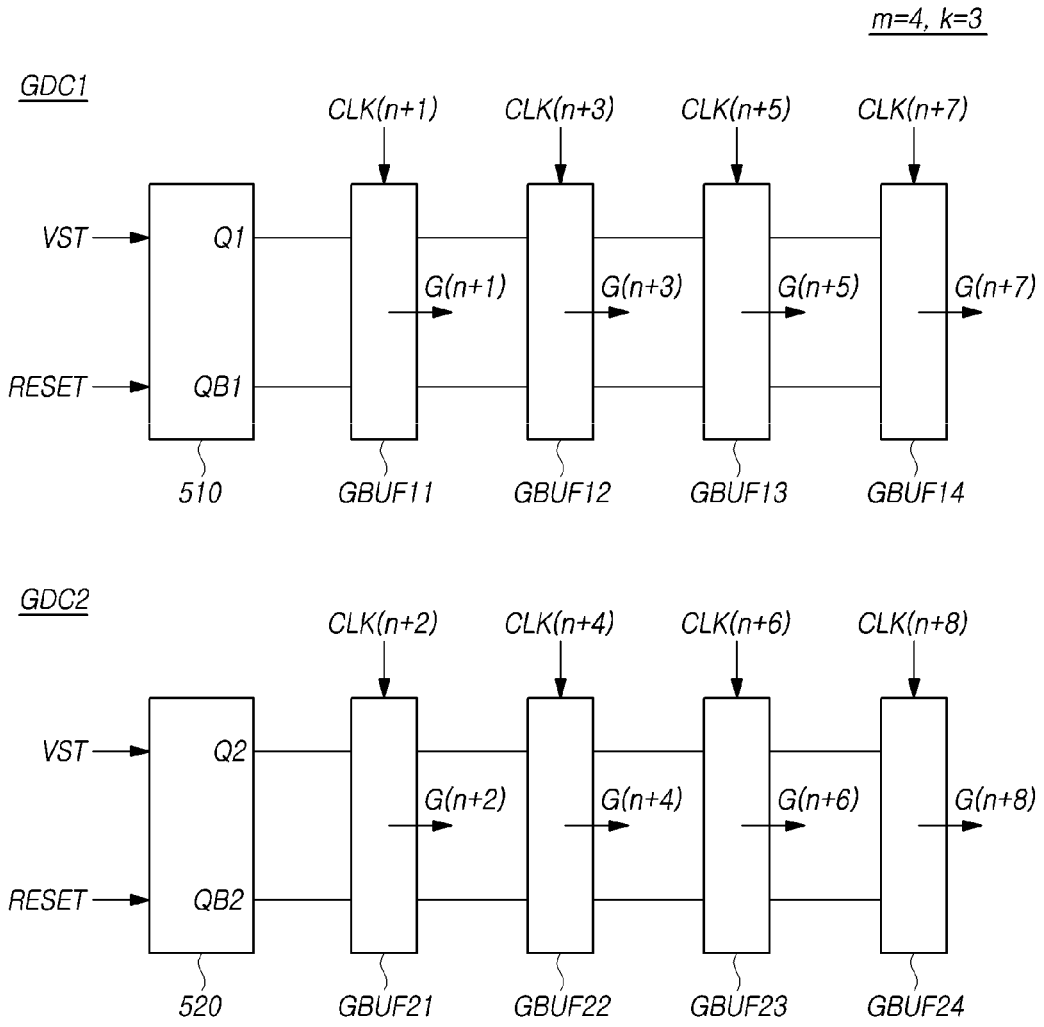
FIG. 14 schematically illustrates the gate driving circuit illustrated in FIG. 10.
Figure 15:
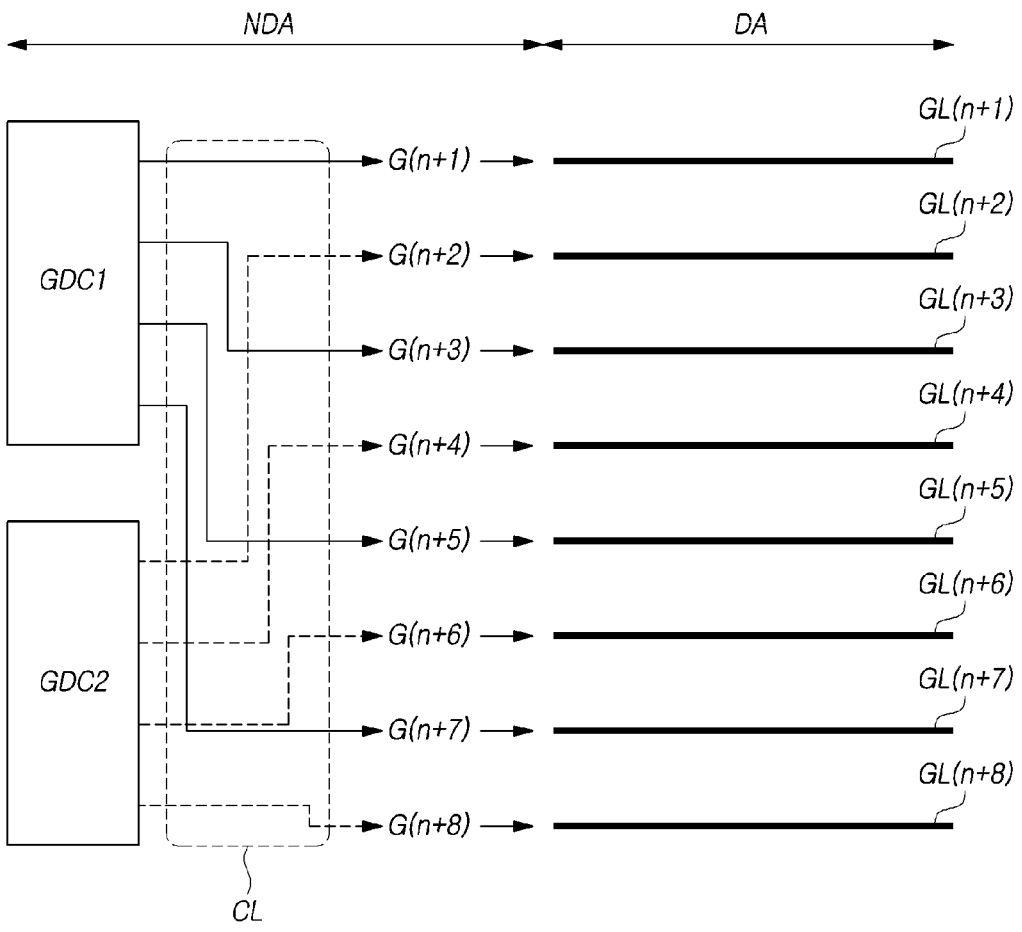
FIGS. 15 and 16 illustrate connection structures between the gate driving circuit of FIG. 14 and gate lines disposed in the display area.
Figure 16:
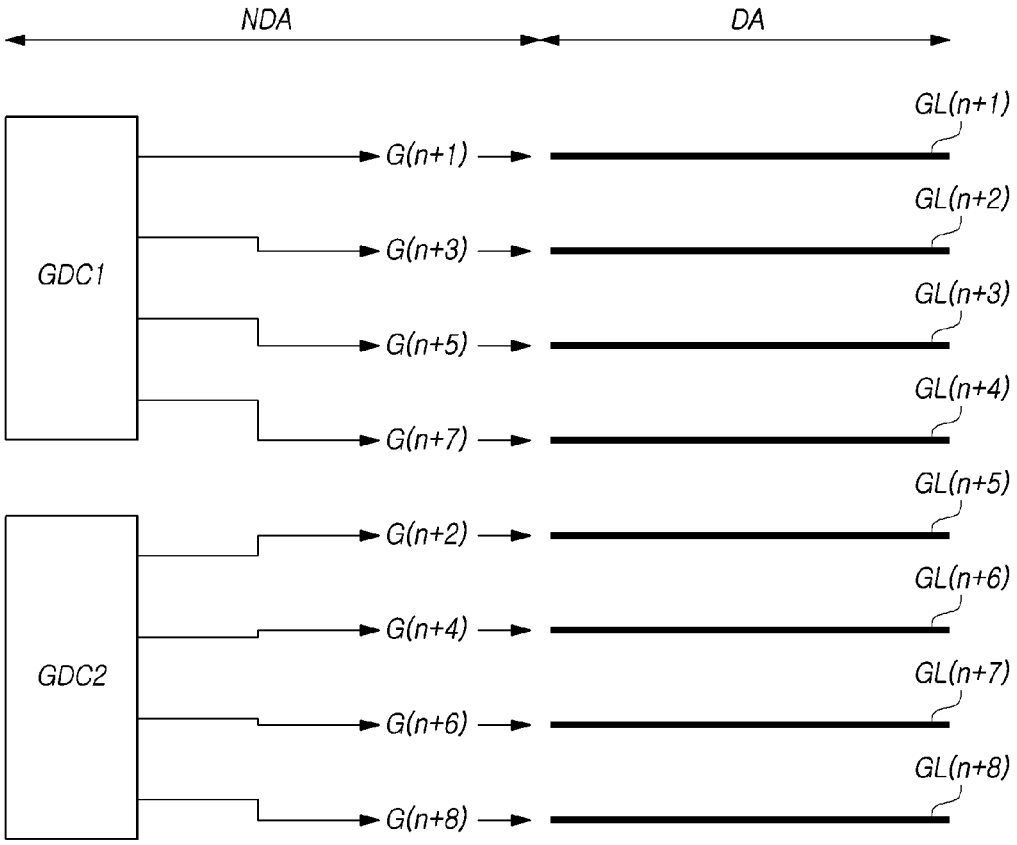

FIG. 14 schematically illustrates the gate driving circuit 130 illustrated in FIG. 10. FIGS. 15 and 16 illustrate connection structures between the gate driving circuit of FIG. 14 and gate lines (GL(n+1) to GL(n+8)) disposed in the display area. Here, an example of m=4 and k=3 is discussed.

Referring to FIG. 15, an (n+1)-th gate signal G(n+1), an (n+3)-th gate signal G(n+3), an (n+5)-th gate signal G(n+5), and an (n+7)-th gate signal G(n+7) may be applied to an (n+1)-th gate line GL(n+1), an (n+3)-th gate line GL(n+3), an (n+5)-th gate line GL(n+5), and an (n+7)-th gate line GL(n+7), respectively.

Referring to FIG. 15, an (n+2)-th gate signal G(n+2), an (n+4)-th gate signal G(n+4), an (n+6)-th gate signal G(n+6), and an (n+8)-th gate signal G(n+8) may be applied to an (n+2)-th gate line GL(n+2), an (n+4)-th gate line GL(n+4), an (n+6)-th gate line GL(n+6), and an (n+8)-th gate line GL(n+8), respectively.

Referring to FIG. 15, as an order in which the gate signals (G(n+1) to G(n+8)) are output from the gate driving circuit 130 and an order in which the gate lines (GL(n+1) to GL(n+8)) are arranged are not consistent, it may be needed to provide one or more separate connection lines CL between output portions of the first gate driving circuit GDC1 and the second gate driving circuit GDC2 included in the gate driving circuit 130 and the display area DA of the display panel 110.

To do this, the display panel 110 may include at least one of a connection line CL connecting between the first output buffer circuit GBUF11 outputting the (n+1)-th gate signal G(n+1) and the (n+1)-th gate line GL(n+1) disposed in the display panel 110, a connection line CL connecting between the first output buffer circuit GBUF12 outputting the (n+3)-th gate signal G(n+3) and the (n+3)-th gate line GL(n+3) disposed in the display panel 110, a connection line CL connecting between the first output buffer circuit GBUF13 outputting the (n+5)-th gate signal G(n+5) and the (n+5)-th gate line GL(n+5) disposed in the display panel 110, a connection line CL connecting between the first output buffer circuit GBUF14 outputting the (n+7)-th gate signal G(n+7) and the (n+7)-th gate line GL(n+7) disposed in the display panel 110, a connection line CL connecting between the second output buffer circuit GBUF21 outputting the (n+2)-th gate signal G(n+2) and the (n+2)-th gate line GL(n+2) disposed in the display panel 110, a connection line CL connecting between the second output buffer circuit GBUF22 outputting the (n+4)-th gate signal G(n+4) and the (n+4)-th gate line GL(n+4) disposed in the display panel 110, a connection line CL connecting between the second output buffer circuit GBUF23 outputting the (n+6)-th gate signal G(n+6) and the (n+6)-th gate line GL(n+6) disposed in the display panel 110, and a connection line CL connecting between the second output buffer circuit GBUF24 outputting the (n+8)-th gate signal G(n+8) and the (n+8)-th gate line GL(n+8) disposed in the display panel 110.

According to the connection structure of FIG. 15, although there is a disadvantage of requiring the separate connection line CL, there is provided an advantage in which data driving can be sequentially performed according to the gate lines (GL(n+1) to GL(n+8)).

Referring to FIG. 16, in the case of k=3, the (n+1)-th gate signal G(n+1), the (n+3)-th gate signal G(n+3), an (n+2)-th gate signal G(n+2), and an (n+4)-th gate signal G(n+4) may be applied to the (n+1)-th gate line GL(n+1), the (n+2)-th gate line GL(n+2), an (n+1+m)-th gate line, and an (n+2+m)-th gate line, respectively.

As shown in FIG. 16, in the case of k=3 and m=4, the (n+1)-th gate signal G(n+1), the (n+3)-th gate signal G(n+3), the (n+5)-th gate signal G(n+5), the (n+7)-th gate signal G(n+7), the (n+2)-th gate signal G(n+2), the (n+4)-th gate signal G(n+4), the (n+6)-th gate signal G(n+6), and the (n+8)-th gate signal G(n+8) may be applied to the (n+1)-th gate line GL(n+1), the (n+2)-th gate line GL(n+2), the (n+3)-th gate line GL(n+3), the (n+4)-th gate line GL(n+4), the (n+5)-th gate line GL(n+5), the (n+6)-th gate line GL(n+6), the (n+7)-th gate line GL(n+7), and the (n+8)-th gate signal GL(n+8), respectively.

As described above, an order in which the gate signals (G(n+1) to G(n+8)) are output from the gate driving circuit 130 and an order in which the gate lines (GL(n+1) to GL(n)+8)) are arranged are consistent. Accordingly, output portions of the gate driving circuit 130 may be directly connected to the gate lines (GL(n+1) to GL(n+8)) disposed in the display area DA of the display panel 110 without a separate connection line. In consequence, the layout of the display panel 110 may be simplified.

Figure 17:
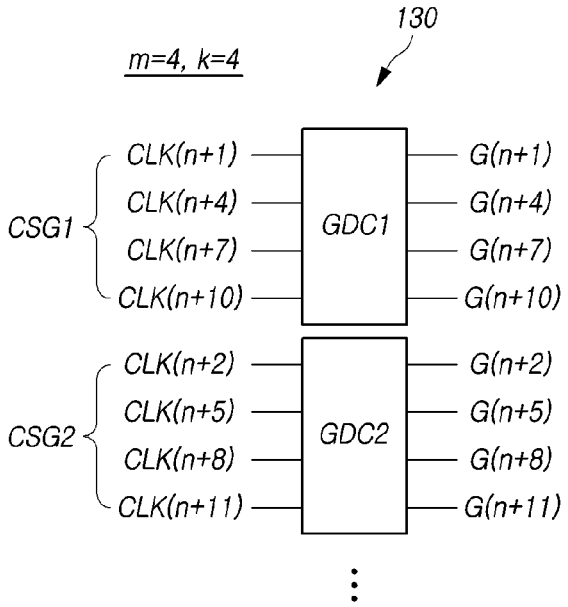
FIG. 17 illustrates an example of the gate driving circuit illustrated in FIG. 7A.

FIG. 17 illustrates an example of the gate driving circuit 130 illustrated in FIG. 7A. In the example of FIG. 17, k=4 different from the configuration in FIG. 9 is applied. However, as described below, it should be understood that various values of k, as well as k=4, may be used. Likewise, various values of m may be used.

Referring to FIG. 17, in the case of k=4 and m=4, the first gate driving circuit GDC1 may include four first output buffer circuits capable of receiving four clock signals (CLK(n+1), CLK(n+4), CLK(n+7), and CLK(n+10)) included in a first clock signal group CSG1, and outputting four gate signals (G(n+1), G(n+4), G(n+7), and G(n+10)). The second gate driving circuit GDC2 may include four second output buffer circuits capable of receiving four clock signals (CLK(n+2), CLK(n+5), CLK(n+8), and CLK(n+11)) included in a second clock signal group CSG2 and outputting four gate signals (G(n+2), G(n+5), G(n+8), and G(n+11)).

Referring to FIG. 17, the first gate driving circuit GDC1 has the second clock input structure. Thus, although the respective high level voltage durations of the four clock signals (CLK(n+1), CLK(n+4), CLK(n+7), and CLK(n+10)) input to the first gate driving circuit GDC1 have a period of 2H, the high level voltage durations do not overlap one another.

In consequence, the respective rising characteristics (rising periods) and falling characteristics (falling periods) of the four gate signals (G(n+1), G(n+4), G(n+7), and G(n+10)) output from the first gate driving circuit GDC1 may be substantially, or nearly, equal, or similar to one another. That is, although the first gate driving circuit GDC1 performs the overlapping gate driving and has the Q node sharing structure, the second clock input structure applied to the first gate driving circuit GDC1 enables output characteristic differences (a rising characteristic difference and a falling characteristic difference) of gate signals to be reduced.

Referring to FIG. 17, the second gate driving circuit GDC2 has the second clock input structure. Thus, although the respective high level voltage durations of the four clock signals (CLK(n+2), CLK(n+5), CLK(n+8), and CLK(n+11))

input to the second gate driving circuit GDC2 have a period of 2H, the high level voltage durations do not overlap one another.

In consequence, the respective rising characteristics (rising periods) and falling characteristics (falling periods) of the four gate signals (G(n+2), G(n+5), G(n+8), and G(n+11)) output from the second gate driving circuit GDC2 may be substantially, or nearly, equal, or similar to one another. That is, although the second gate driving circuit GDC2 performs the overlapping gate driving and has the Q node sharing structure, the second clock input structure applied to the second gate driving circuit GDC2 enables output characteristic differences (a rising characteristic difference and a falling characteristic difference) of gate signals to be reduced.

According to the embodiments described herein, it is possible to provide the gate driving circuit having the clock input structure capable of reducing differences in output characteristics between gate signals, and thereby, improving image quality, and the display device including the gate driving circuit.

According to the embodiments described herein, it is possible to provide the gate driving circuit having the clock input structure in which overlap gate driving and the Q node sharing structure are enabled while reducing differences in output characteristics between gate signals, and the display device including the gate driving circuit.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present disclosure. The above description and the accompanying drawings provide an example of the technical idea of the present disclosure for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present disclosure should be construed based on the following claims, and all technical ideas within the scope of equivalents thereof should be construed as being included within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel including a plurality of gate lines; and a gate driving circuit including:

a first gate driving circuit capable of outputting m number of first gate signals using a first clock signal group; and a second gate driving circuit capable of outputting m number of second gate signals using a second clock signal group different from the first clock signal group, where the m is a natural number of 2 or more, wherein the first clock signal group and the second clock signal group respectively include m number of first clock signals and m number of second clock signals, and 2 m number of clock signals including the m number of first clock signals included in the first clock signal group and the m number of second clock signals included in the second clock signal group have respective high level voltage durations at different timings, wherein the first gate driving circuit includes m number of first output buffer circuits configured to receive the m number of first clock signals and to output the m number of first gate signals, and a first control circuit capable of controlling the m number of first output buffer circuits, and each of the m number of first output buffer circuits includes a pull-up transistor and a pull-down transistor, wherein all gate nodes of respective pull-up transistors included in the m number of first output buffer circuits are electrically connected to one first Q node, wherein the second gate driving circuit includes m number of second output buffer circuits configured to receive the m number of second clock signals and to output the m number of second gate signals, and a second control circuit capable of controlling the m number of second output buffer circuits, and each of the m number of second output buffer circuits includes a pull-up transistor and a pull-down transistor, wherein all gate nodes of respective pull-up transistors included in the m number of second output buffer circuits are electrically connected to one second Q node, wherein the m number of first clock signals input to the first gate driving circuit includes an (n+1)-th clock signal and an (n+k)-th clock signal, and the m number of second clock signals input to the second gate driving circuit includes an (n+2)-th clock signal and an (n+k+1)-th clock signal, wherein the n is any integer, where the k is a natural number of 3 or more, wherein a high level voltage duration of the (n+1)-th clock signal and a high level voltage duration of the (n+k)-th clock signal do not overlap, and wherein a high level voltage duration of the (n+2)-th clock signal and a high level voltage duration of the (n+k+1)-th clock signal do not overlap.

2. The display device according to claim 1, wherein the k is 3 or 4.

3. The display device according to claim 2, wherein when the k is 3, the m number of first output buffer circuits included in the first gate driving circuit includes:

a first first output buffer circuit for receiving the (n+1)-th clock signal and outputting an (n+1)-th gate signal; and a second first output buffer circuit for receiving an (n+3)-th clock signal and outputting an (n+3)-th gate signal; and the m number of second output buffer circuits included in the second gate driving circuit includes:

a first second output buffer circuit for receiving the (n+2)-th clock signal and outputting an (n+2)-th gate signal; and a second second output buffer circuit for receiving an (n+4)-th clock signal and outputting an (n+4)-th gate signal.

4. The display device according to claim 3, wherein when the m is 4, the m number of first output buffer circuits included in the first gate driving circuit includes:

a third first output buffer circuit for receiving an (n+5)-th clock signal and outputting an (n+5)-th gate signal; and a fourth first output buffer circuit for receiving an (n+7)-th clock signal and outputting an (n+7)-th gate signal; and the m number of second output buffer circuits included in the second gate driving circuit includes:

a third second output buffer circuit for receiving an (n+6)-th clock signal and outputting an (n+6)-th gate signal; and a fourth second output buffer circuit for receiving an (n+8)-th clock signal and outputting an (n+8)-th gate signal.

5. The display device according to claim 4, wherein the (n+1)-th gate signal is applied to an (n+1)-th gate line, the (n+3)-th gate signal is applied to an (n+3)-th gate line, the (n+5)-th gate signal is applied to an (n+5)-th gate line, the (n+7)-th gate signal is applied to an (n+7)-th gate line, the (n+2)-th gate signal is applied to an (n+2)-th gate line, the (n+4)-th gate signal is applied to an (n+4)-th gate line, the (n+6)-th gate signal is applied to an (n+6)-th gate line, and the (n+8)-th gate signal is applied to an (n+8)-th gate line.

6. The display device according to claim 5, further comprising at least one of:

a connection line connecting between the first first output buffer circuit outputting the (n+1)-th gate signal and the (n+1)-th gate line disposed in the display panel;

a connection line connecting between the second first output buffer circuit outputting the (n+3)-th gate signal and the (n+3)-th gate line disposed in the display panel;

a connection line connecting between the third first output buffer circuit outputting the (n+5)-th gate signal and the (n+5)-th gate line disposed in the display panel;

a connection line connecting between the fourth first output buffer circuit outputting the (n+7)-th gate signal and the (n+7)-th gate line disposed in the display panel;

a connection line connecting between the first second output buffer circuit outputting the (n+2)-th gate signal and the (n+2)-th gate line disposed in the display panel;

a connection line connecting between the second second output buffer circuit outputting the (n+4)-th gate signal and the (n+4)-th gate line disposed in the display panel;

a connection line connecting between the third second output buffer circuit outputting the (n+6)-th gate signal and the (n+6)-th gate line disposed in the display panel; and a connection line connecting between the fourth second output buffer circuit outputting the (n+8)-th gate signal and the (n+8)-th gate line disposed in the display panel.

7. The display device according to claim 3, wherein the (n+1)-th gate signal is applied to an (n+1)-th gate line, the (n+3)-th gate signal is applied to an (n+3)-th gate line, the (n+2)-th gate signal is applied to an (n+2)-th gate line, and the (n+4)-th gate signal is applied to an (n+4)-th gate line.

8. The display device according to claim 7, further comprising at least one of:

a connection line connecting between the first first output buffer circuit for outputting the (n+1)-th gate signal and the (n+1)-th gate line disposed in the display panel;

a connection line connecting between the second first output buffer circuit for outputting the (n+3)-th gate signal and the (n+3)-th gate line disposed in the display panel;

a connection line connecting between the first second output buffer circuit for outputting the (n+2)-th gate signal and the (n+2)-th gate line disposed in the display panel; and a connection line connecting between the second second output buffer circuit for outputting the (n+4)-th gate signal and the (n+4)-th gate line disposed in the display panel.

9. The display device according to claim 3, wherein the (n+1)-th gate signal is applied to an (n+1)-th gate line, the (n+3)-th gate signal is applied to an (n+2)-th gate line, the (n+2)-th gate signal is applied to an (n+1+m)-th gate line, and the (n+4)-th gate signal is applied to an (n+2+m)-th gate line.

10. The display device according to claim 9, wherein the (n+1)-th gate signal is applied to the (n+1)-th gate line, the (n+3)-th gate signal is applied to the (n+2)-th gate line, an (n+5)-th gate signal is applied to an (n+3)-th gate line, an (n+7)-th gate signal is applied to an (n+4)-th gate line, the (n+2)-th gate signal is applied to the (n+1+m)-th gate line, the (n+4)-th gate signal is applied to the (n+2+m)-th gate line, an (n+6)-th gate signal is applied to an (n+3+m)-th gate line, and an (n+8)-th gate signal is applied to an (n+4+m)-th gate line.

11. The display device according to claim 1, wherein the high level voltage duration of the (n+1)-th clock signal input to the first gate driving circuit and the high level voltage duration of the (n+2)-th clock signal input to the second gate driving circuit partially overlap, and wherein the high level voltage duration of the (n+k)-th clock signal input to the first gate driving circuit and the high level voltage duration of the (n+k+1)-th clock signal input to the second gate driving circuit partially overlap.

12. The display device according to claim 1, wherein the m equals to the number of pull-up transistors whose gate nodes are commonly connected to the one first Q node and equals to the number of pull-up transistors whose gate nodes are commonly connected to the one second Q node.

13. The display device according to claim 1, wherein the k is proportional to a length of a high level voltage duration of each of the 2 m number of clock signals, and a value obtained by multiplying one horizontal period by (k−1) equals to the length of the high level voltage duration of each of the 2 m number of clock signals.

14. The display device according to claim 1, wherein the first gate driving circuit is configured to output an (n+1)-th gate signal based on the (n+1)-th clock signal and an (n+k)-th gate signal based on the (n+k)-th clock signal, and the second gate driving circuit is configured to output an (n+2)-th gate signal based on the (n+2)-th clock signal and an (n+k+1)-th gate signal based on the (n+k+1)-th clock signal, and wherein a turn-on level voltage duration of the (n+1)-th gate signal partially overlaps a turn-on level voltage duration of the (n+2)-th gate signal, and a turn-on level voltage duration of the (n+1)-th gate signal does not overlap a turn-on level voltage duration of the (n+k)-th gate signal.

15. The display device according to claim 1, wherein the display panel includes a display area and a non-display area different from the display area, and the gate driving circuit is disposed in the non-display area.

16. A gate driving circuit capable of driving a plurality of gate lines disposed in a display panel, the gate driving circuit comprising:

a first gate driving circuit configured to output m number of first gate signals using a first clock signal group; and a second gate driving circuit configured to output m number of second gate signals using a second clock signal group, where the m is a natural number of 2 or more, wherein the first clock signal group and the second clock signal group respectively include m number of first clock signals and m number of second clock signals, and 2 m number of clock signals including the m number of first clock signals included in the first clock signal group and the m number of second clock signals included in the second clock signal group have respective high level voltage durations at different timings, wherein the first gate driving circuit includes m number of first output buffer circuits configured to receive the m number of first clock signals and output the m number of first gate signals, and a first control circuit capable of controlling the m number of first output buffer circuits, and each of the m number of first output buffer circuits includes a pull-up transistor and a pull-down transistor, wherein all gate nodes of respective pull-up transistors included in the m number of first output buffer circuits are electrically connected to one first Q node, wherein the second gate driving circuit includes m number of second output buffer circuits configured to receive the m number of second clock signals and output the m number of second gate signals, and a second control circuit capable of controlling the m number of second output buffer circuits, and each of the m number of second output buffer circuits includes a pull-up transistor and a pull-down transistor, wherein all gate nodes of respective pull-up transistors included in the m number of second output buffer circuits are electrically connected to one second Q node, wherein the m number of first clock signals input to the first gate driving circuit includes an (n+1)-th clock signal and an (n+k)-th clock signal, and the m number of second clock signals input to the second gate driving circuit includes an (n+2)-th clock signal and an (n+k+1)-th clock signal, where the n is any integer, and the k is a natural number of 3 or more, wherein a high level voltage duration of the (n+1)-th clock signal and a high level voltage duration of the (n+k)-th clock signal do not overlap, and wherein a high level voltage duration of the (n+2)-th clock signal and a high level voltage duration of the (n+k+1)-th clock signal do not overlap.

17. The gate driving circuit according to claim 16, wherein the high level voltage duration of the (n+1)-th clock signal input to the first gate driving circuit and the high level voltage duration of the (n+2)-th clock signal input to the second gate driving circuit partially overlap, and wherein the high level voltage duration of the (n+k)-th clock signal input to the first gate driving circuit and the high level voltage duration of the (n+k+1)-th clock signal input to the second gate driving circuit partially overlap.

18. The gate driving circuit according to claim 16, wherein the first gate driving circuit is configured to output an (n+1)-th gate signal based on the (n+1)-th clock signal and an (n+k)-th gate signal based on the (n+k)-th clock signal, the second gate driving circuit is configured to output an (n+2)-th gate signal based on the (n+2)-th clock signal and an (n+k+1)-th gate signal based on the (n+k+1)-th clock signal, a turn-on level voltage duration of the (n+1)-th gate signal partially overlaps a turn-on level voltage duration of the (n+2)-th gate signal, and the turn-on level voltage duration of the (n+1)-th gate signal does not overlap a turn-on level voltage duration of the (n+k)-th gate signal.

* * * * *